US010002524B2

(12) United States Patent
Shim et al.

(10) Patent No.: US 10,002,524 B2
(45) Date of Patent: Jun. 19, 2018

(54) METHOD AND APPARATUS FOR CONTROLLING DEVICES IN HOME NETWORK SYSTEM

(71) Applicant: Samsung Electronics Co., Ltd., Suwon-si, Gyeonggi-do (KR)

(72) Inventors: Jung-Hyun Shim, Seongnam-si (KR); Kyung-Jae Kim, Suwon-si (KR); Keun-Cheol Lee, Incheon (KR); Kyung-Tack Kwon, Seoul (KR); Hae-Moon Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 14/105,907

(22) Filed: Dec. 13, 2013

(65) Prior Publication Data

US 2014/0167929 A1 Jun. 19, 2014

(30) Foreign Application Priority Data

Dec. 13, 2012 (KR) ..... 10-2012-0145009

(51) Int. Cl.
*G08C 17/02* (2006.01)

(52) U.S. Cl.
CPC ..... *G08C 17/02* (2013.01); *G08C 2201/41* (2013.01)

(58) Field of Classification Search
CPC . G08C 17/02; G08C 2201/40–2201/42; G05B 15/02; G05B 2219/2642; G06F 3/0482; G06F 8/61; G06F 21/44; H04L 12/285; H04L 2012/2841; H04M 1/72533; H04N 21/43615; H04W 60/00;
(Continued)

(56) References Cited

U.S. PATENT DOCUMENTS 6,563,430 B1 * 5/2003 Kemink ..... H04N 21/42202 340/12.22
6,924,727 B2 8/2005 Nagaoka et al.
(Continued)

FOREIGN PATENT DOCUMENTS

CN 100530047 C 8/2009
CN 101667254 A 3/2010
(Continued)

OTHER PUBLICATIONS

European Patent Office (EPO) search report, Application EP15195038.3, dated Mar. 7, 2016, 7 pages.

*Primary Examiner* — Quan-Zhen Wang
*Assistant Examiner* — Stephen Burgdorf
(74) *Attorney, Agent, or Firm* — Jefferson IP Law, LLP

(57) ABSTRACT

A method and apparatus for controlling groups of devices in a home network system are provided. The method includes receiving a request message for executing a first operation mode from a mobile station through the Internet, reading a control list stored for the first operation mode, in order to determine home devices associated with the first operation mode and in order to determine functions of the home devices, in response to the request message, transmitting control commands, instructing the home devices to execute the functions, to the home devices, respectively, according to the control list, and reporting the results of execution of the functions, according to the control commands, to the mobile station.

25 Claims, 28 Drawing Sheets

(58) Field of Classification Search
CPC ..... H04W 76/02; H04W 48/18; H04W 84/12; H04W 88/16
USPC ..... 340/12.5, 11.1; 370/21, 338, 401; 455/432.1, 435.1, 435.2
See application file for complete search history.

(56) References Cited

U.S. PATENT DOCUMENTS 8,229,461 B1* 7/2012 Manroa ..... H04W 4/025 455/414.2
2001/0025349 A1* 9/2001 Sharood ..... G06Q 30/0235 713/340
2003/0188199 A1* 10/2003 Tadano ..... G06F 21/35 726/35
2004/0150546 A1* 8/2004 Choi ..... H04B 1/202 341/176
2006/0104291 A1* 5/2006 Rodriguez ..... H04B 3/54 370/401
2007/0057792 A1* 3/2007 Alden ..... G06F 3/0202 340/572.1
2007/0067300 A1* 3/2007 Ollis ..... H04L 12/2829
2007/0146136 A1* 6/2007 Chen ..... G01C 21/20 340/572.1
2007/0149189 A1 6/2007 Yang et al.
2008/0064395 A1 3/2008 Sibileau
2008/0254833 A1* 10/2008 Keevill ..... H04L 12/5692 455/558
2009/0072991 A1 3/2009 Hayashi et al.
2010/0097225 A1* 4/2010 Petricoin, Jr. ..... G07C 9/00111 340/573.1
2010/0156608 A1* 6/2010 Bae ..... H04Q 9/00 340/10.5
2010/0317366 A1 12/2010 Shen et al.
2011/0248866 A1* 10/2011 Chutorash ..... G08C 17/00 340/901
2012/0254401 A1 10/2012 Adams et al.
2012/0280783 A1* 11/2012 Gerhardt ..... G07C 9/00309 340/5.6
2013/0221094 A1* 8/2013 Smith ..... G07C 9/00309 235/382
2013/0237152 A1* 9/2013 Taggar ..... H04B 5/00 455/41.1
2013/0243199 A1* 9/2013 Kallai ..... G11B 19/02 381/17
2013/0300547 A1* 11/2013 Park ..... H04L 12/2809 340/12.22
2014/0039888 A1* 2/2014 Taubman ..... H04M 1/72572 704/235
2014/0062650 A1* 3/2014 Yamada ..... G06F 21/34 340/5.3

FOREIGN PATENT DOCUMENTS

CN 101848126 A 9/2010
KR 10-2011-0131655 A 12/2011
WO 00/17737 A1 3/2000

* cited by examiner

METHOD AND APPARATUS FOR CONTROLLING DEVICES IN HOME NETWORK SYSTEM

CROSS-REFERENCE TO RELATED APPLICATION(S)

This application claims the benefit under 35 U.S.C. § 119(a) of a Korean patent application filed on Dec. 13, 2012 in the Korean Intellectual Property Office and assigned Serial No. 10-2012-0145009, the entire disclosure of which is hereby incorporated by reference.

TECHNICAL FIELD

The present disclosure relates to a home network system. More particularly, the present disclosure relates to a method and apparatus for controlling a plurality of home devices according to pre-determined operation modes.

BACKGROUND

A home network system controls home devices installed in a home by connecting the home devices to each other through a wired/wireless network. An enhanced home network system provides various services connected to the Internet by integrating home devices through a Home Gate-Way (HGW or H-GW) to connect to an external shared data network, for example, an Internet Protocol (IP) network, that is, the Internet, or any other similar and/or suitable data network. The home network system can provide a user's desired services by controlling home devices according to the user's requirements.

Lately, with a variety of home devices and a variety of user requirements, a need to provide optimal services in response to the variety of user requirements is increasing.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method and apparatus for providing services in a home network system.

Another aspect of the present disclosure is to provide a method and apparatus for controlling groups of home devices through a home network system.

Another aspect of the present disclosure is to provide a method and apparatus for controlling home devices at once when a pre-determined operation condition is satisfied in a home network system.

Another aspect of the present disclosure is to provide a method and apparatus for controlling home devices included in a home network system through a control station.

Another aspect of the present disclosure is to provide a method and apparatus for executing predetermined functions of home devices at once when a user goes out and/or leaves a home, in a home network system.

Another aspect of the present disclosure is to provide a method and apparatus for executing predetermined functions of home devices at once when a user comes home, in a home network system.

In accordance with an aspect of the present disclosure, a method in which a home gateway controls groups of home devices in a home network system is provided. The method includes receiving a request message for executing an operation mode from a control station, reading a control list stored for the operation mode in response to the request message, determining at least one home device associated with the operation mode from among home devices in the home network system and one or more functions of the at least one home device based on the control list, and transmitting control commands instructing the at least one home device to execute the one or more functions, to the at least one home device.

In accordance with another aspect of the present disclosure, a method in which a control station controls home devices in a home network system is provided. The method comprises determining an operation mode based on at least one of tag information, location information of the control station, state information of at least one of home devices, and input from a user of the control station, and transmitting a request message for executing the operation mode to a home gateway of the home network system.

In accordance with another aspect of the present disclosure, an apparatus in a home gateway for controlling home devices in a home network system is provided. The apparatus comprises a communication interface module configured to receive a request message for executing a operation mode from a control station and to transmit control commands, for home devices, to the home devices, respectively, and a controller configured to read a control list stored for the operation mode in response to the request message, to determine at least one home device associated with the operation mode from among home devices in the home network system and one or more functions of the at least one home device based on the control list, and to generate the control commands instructing the at least one home device to execute the one or more functions.

In accordance with another aspect of the present disclosure, an apparatus in a control station for controlling home devices in a home network system is provided. The apparatus comprises a controller configured to determine an operation mode based on at least one of tag information, location information of the control station, state information of at least one of home devices, and input from a user of the control station, and a communication interface module configured to transmit a request message for executing the operation mode to a home gateway of the home network system.

In accordance with another aspect of the present disclosure, a method in which a home gateway controls home devices in a home network system is provided. The method comprises receiving, from a control station, a request message for executing an operation mode, and broadcasting the request message corresponding to the operation mode to home devices in the home network system.

In accordance with another aspect of the present disclosure, a method in which a home device operates in a home network system is provided. The method comprises receiving, by a home device, a request message corresponding to an operation mode, determining, by the home device, whether the home device is associated with the operation mode and executes the operation mode or not in response to receiving the request message, and executing, by the home device, one or more functions associated with the operation mode when it is determined that the home device is associated with the operation mode.

In accordance with another aspect of the present disclosure, an apparatus in a home gateway for controlling home devices in a home network system is provided. The apparatus comprises a communication interface module configured to receive, from a control station, a request message corresponding to an operation mode, and to broadcasting the request message corresponding to the operation mode to home devices in the home network system, and a controller configured to control the communication interface module in response to the request message.

In accordance with another aspect of the present disclosure, an apparatus of a home device operating in a home network system is provided. The apparatus comprises a communication interface module configured to receiving a request message corresponding to an operation mode, and a controller configured to determine whether that the home device is associated with the operation mode and executes the operation mode or not in response to receiving the request message, and execute one or more functions associated with the operation mode when it is determined that the home device is associated with the operation mode.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the present disclosure. Accordingly, it should be apparent to those skilled in the art that the following description of various embodiments of the present disclosure is provided for illustration purposes only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the singular forms "a", "an" and "the" are intended to include the plural forms as well, unless the context clearly indicates otherwise.

Figure 1:
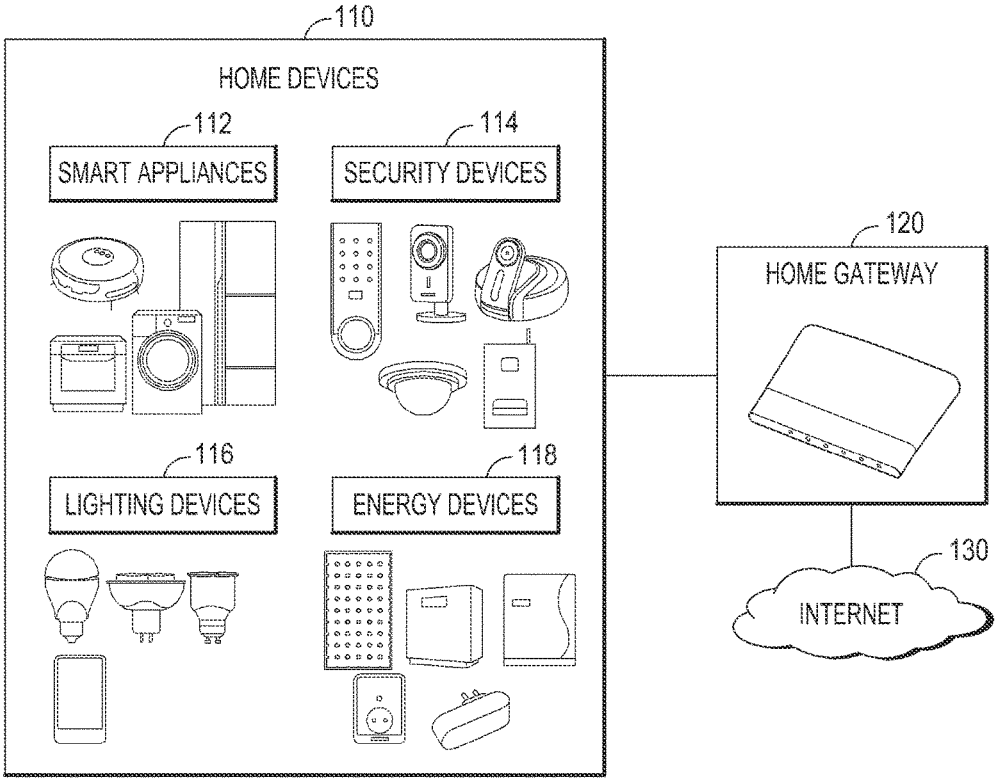
FIG. 1 illustrates a simplified configuration of a home network system according to an embodiment of the present disclosure.

FIG. 1 illustrates a simplified configuration of a home network system according to an embodiment of the present disclosure.

Referring to FIG. 1, the home network system may include home devices 110 having control and communication functions, and a Home Gateway (HGW) 120. The home devices 110 may be located inside and/or outside a home, and may include smart appliances 112, security devices 114, lighting devices 116, and energy devices 118. For example, the smart appliances 112 may include a TeleVision (TV), an air conditioner, a refrigerator, a washing machine, a robot cleaner, a humidifier, and any other similar and/or suitable appliance, the security devices 114 may include a door lock, a security camera, a Closed Circuit TV (CCTV), a security sensor being sensible a contact, a sound and/or a motion, and any other similar and/or security device, the lighting devices 116 may include a Light Emitting Diode (LED), a lamp, and any other similar and/or lighting device, and the energy devices 118 may include a heater, a motor meter, a power socket, an electrical outlet, a multiple-tap, and any other similar and/or energy device. Additionally, the home devices 110 may include a Personal Computer (PC), an IP camera, an Internet phone, a wired/wireless phone, a home mobile phone, and electrically controllable curtains or blinds.

The home devices 110 may communicate with a home gateway 120 according to a wired/wireless communication technique, may receive control commands from the home gateway 120 to operate according to the control commands, and may transmit requested information and/or data to the home gateway 120.

The home gateway 120 may be implemented as an independent entity or as a device having home gateway functions. For example, the home gateway 120 may be implemented as a TV, a feature phone, a set-top box, a robot cleaner, a personal computer (PC) or a tablet PC. The home gateway 120 may include communication modules for communicating with the home devices 110 according to the wired/wireless communication technique, may register and store information about the home devices 110, may manage and control operations, supportable functions and states of the home devices 110, may collect information from the home devices 110, and may store the collected information. Specifically, the home gateway 120 may connect to a data network such as the Internet 130, that is, to an IP network to allow a connection of another communication terminal through the Internet 130, and may transmit a control signal received from the communication terminal to the corresponding home device. The home gateway 120 may be implemented as an independent apparatus, as illustrated in FIG. 1, or may be implemented as a hardware module or a software module installed in at least one of the home devices 110, which is not illustrated in FIG. 1.

The home network system configured as described above may provide home entertainment services including Internet Protocol TV (IPTV) through the Internet 130 and Video on Demand (VoD), home data communication services including data sharing, Voice over IP (VoIP), and video telephony, and home automation services including remote control of home appliances, remote metering, crime prevention, and disaster prevention. That is, the home network system may control all kinds of home devices that are used inside or outside the home by connecting the home devices through a network.

Meanwhile, a user may connect to the home gateway 120 included in the home network system using a wireless communication apparatus such as a mobile station and/or using an Internet device such as a PC when he/she is out, or the user may connect to each home device remotely through the home gateway 120. The mobile station may be a Personal Digital Assistant (PDA), a feature phone, a smart phone, a mobile phone, a PC, a tablet PC, or a laptop computer, having a communication function, and the mobile station may access the home network system through a provider network and the Internet or directly.

Figure 2:
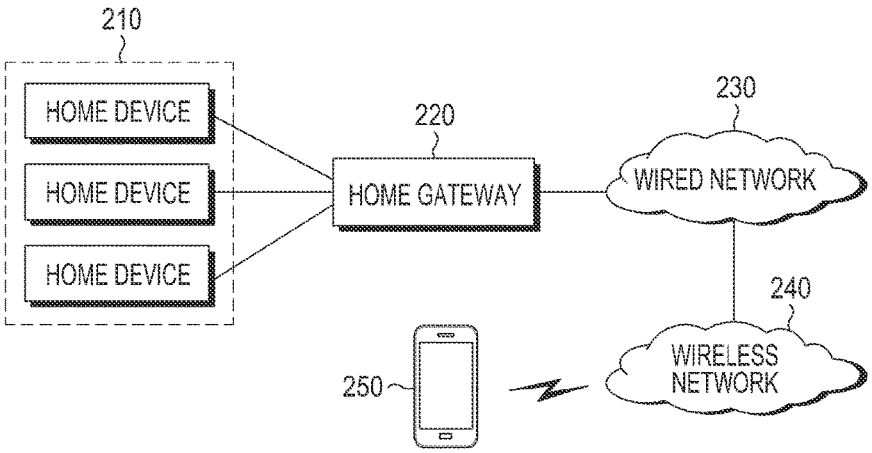
FIG. 2 illustrates a simplified configuration of a home network system that is connectable to a mobile station according to an embodiment of the present disclosure.

FIG. 2 illustrates a simplified configuration of a home network system that is connectable to a mobile station according to an embodiment of the present disclosure.

Referring to FIG. 2, home devices 210 included in a home network system may connect to a home gateway 220 according to a wired/wireless communication technique. The home gateway 220 may connect to a wired network 230, such as the Internet, as illustrated in FIG. 2. Alternatively, the home gateway 220 may connect to a wireless network 240. In this case, the home gateway 220 may function as a small-sized home base station. A registered mobile station 250 may connect to the wireless network 240, including a wireless access network and a provider core network, and may access the home gateway 220 through the wired network 230. The wireless network 240 may be based on a $2^{nd}$ Generation (2G) or a $3^{rd}$ Generation (3G) cellular communication system, a 3G Partnership Project (3GPP), a $4^{th}$ Generation (4G) communication system, Long-Term Evolution (LTE), World Interoperability for Microwave Access (WiMAX), or any other similar and/or suitable type of wireless network type. In an alternative embodiment, the mobile station 250 may communicate with the home gateway 220 directly by using a Wireless Fidelity (WiFi), ZigBee, Bluetooth, a Near-Field Communication (NFC), z-wave, etc.

Figure 3:
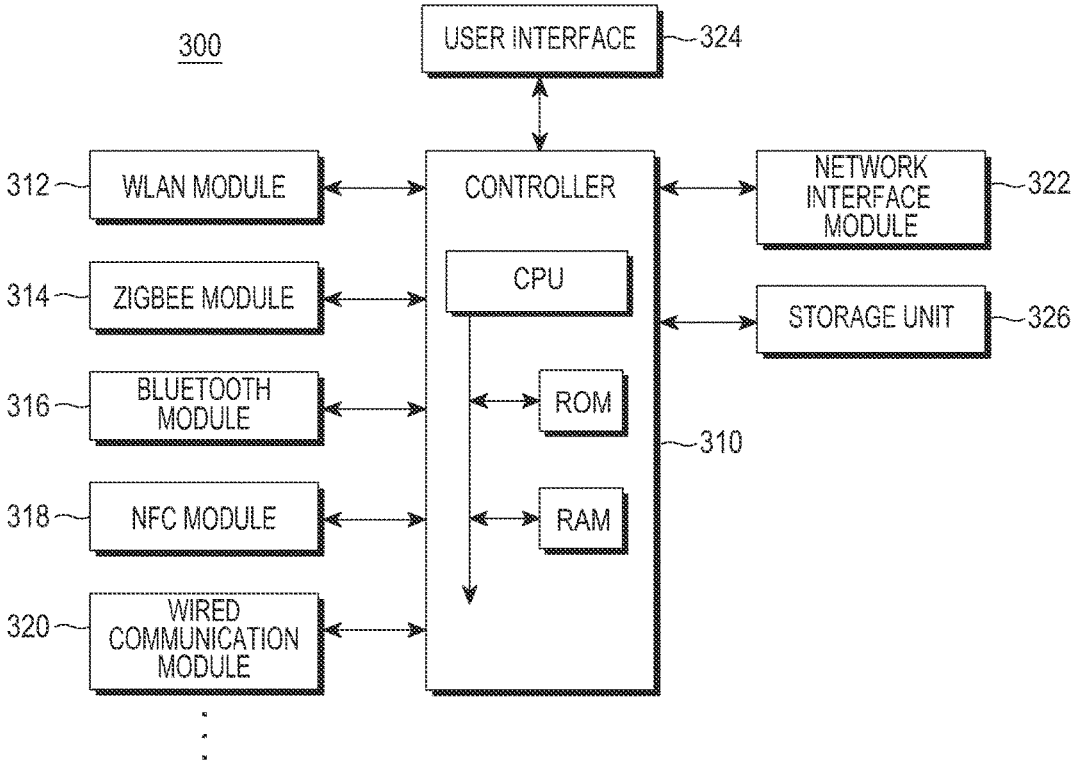
FIG. 3 is a block diagram illustrating a simplified configuration of a home gateway according to an embodiment of the present disclosure.

FIG. 3 is a block diagram illustrating a simplified configuration of a home gateway according to an embodiment of the present disclosure. The home gateway may be configured to include at least one of components illustrated in FIG. 3.

Referring to FIG. 3, a home gateway 300 may connect to home devices (not shown) using one or more communication modules. The communication modules may include at least one of a Wireless Local Area Network (WLAN) module 312 such as a WiFi module, a ZigBee module 314, a Bluetooth module 316, a NFC module 318, and a wired communication module 320. One or more communication modules like as a z-wave not shown are included in the home gateway 300. Also, the home gateway 300 may include a controller 310, a network interface module 322, a user interface 324, and a storage unit 326.

The controller 310 may include a Central Processing Unit (CPU), a Read-Only Memory (ROM) in which control programs for controlling the home gateway 300 are stored, and a Random Access Memory (RAM) in which tasks executed by the home gateway 300 are stored. The controller 310 may communicate with the home devices through the communication modules 312 through 320 by executing programs stored in the ROM or RAM or application programs that can be stored in the storage unit 326, may generate control commands to transmit the control commands to the home devices, or may store information collected from the home devices in the storage unit 326.

The user interface 324 may include an output module and an input module, wherein the output module includes a display, a speaker, and an alarm lamp, and the input module includes a touch screen, a keypad, and a microphone. The user interface 324 may enable a user to control the home gateway 300, to register/delete the home devices in/from the home gateway 300, or to control the home devices through the home gateway 300.

The network interface 324 may be an internet communication module, and may connect the home gateway 300 to an external network.

The storage unit 326 may be configured to store program codes, data, or information required for operations of the home gateway 300 under the control of the controller 310, and may store a large amount of data transferred from external devices or home devices as necessary.

Figure 4:
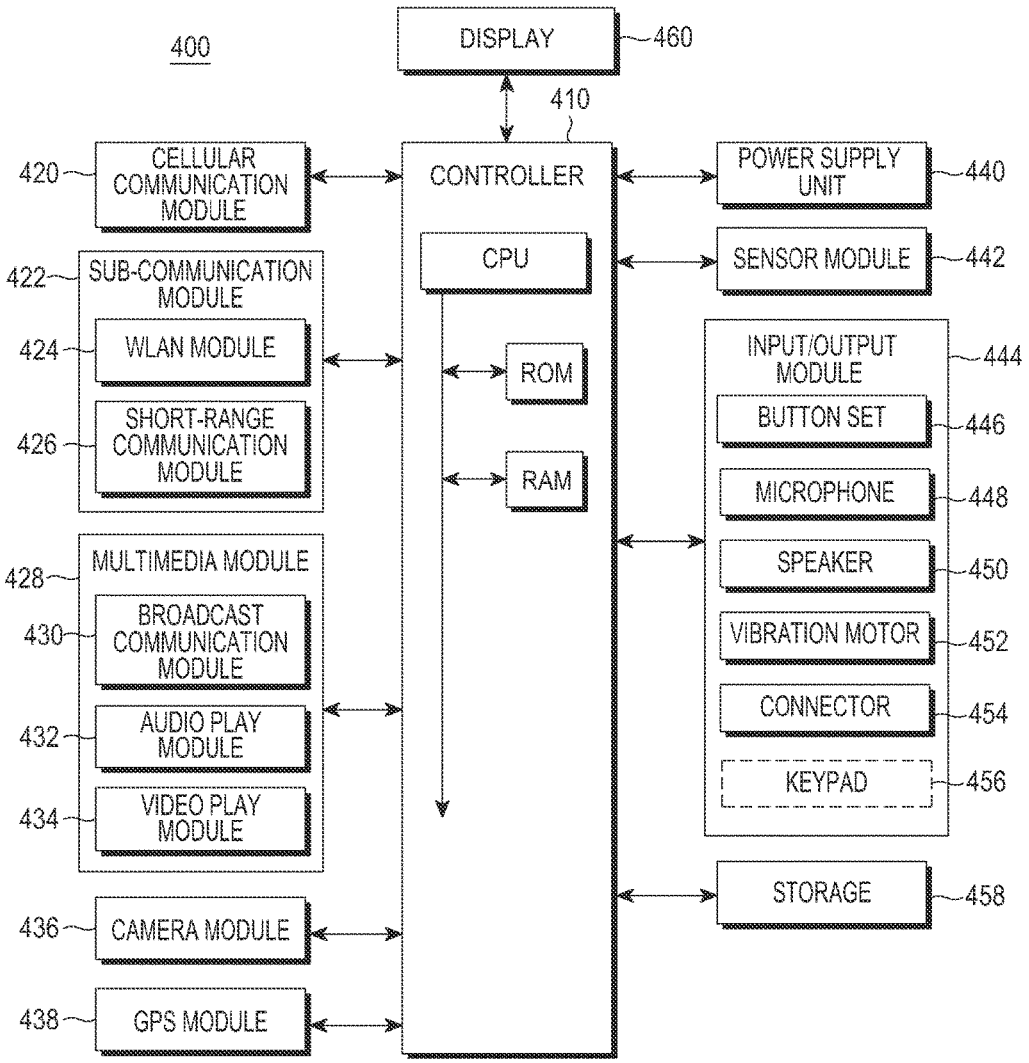
FIG. 4 is a block diagram illustrating a simplified configuration of a mobile station according to an embodiment of the present disclosure.

FIG. 4 is a block diagram illustrating a simplified configuration of a mobile station according to an embodiment of the present disclosure. The mobile station may be configured to include at least one of components illustrated in FIG. 4.

Referring to FIG. 4, a mobile station 400 may include a controller 410, a cellular mobile communication module 420, a sub communication module 422, a multimedia module 428, a camera module 436, a Global Positioning System (GPS) module 438, an input/output module 444, a sensor module 442, a storage unit 458, a power supply unit 440, and at least one display module 460. The sub communication module 422 may include at least one of a WLAN module 424 and a short-range communication module 426, and the multimedia module 428 may include at least one of a broadcast communication module 430, an audio play module 432, and a video play module 434. The camera module 436 may include at least one camera (not shown), and the input/output module 444 may include at least one of a button set 446, a microphone 448, a speaker 450, a vibration motor 452, a connector 454, and a keypad 456.

The controller 410 may include a CPU, a ROM in which control programs for controlling the mobile station 400 are stored, and a RAM in which signals or data input from an external device or tasks executed by the mobile station 400 are stored. The controller 410 may control components of the mobile station 400.

The cellular mobile communication module 420 enables the mobile station 400 to connect to an external device, such as a base station of a cellular system, through at least one or a plurality of antennas (not shown) using a wireless access technique according to a cellular communication protocol under the control of the controller 410. The cellular mobile communication module 420 may transmit/receive radio signals including a voice call, a video call, a Short Messaging Service (SMS) message, a Multimedia Messaging Service (MMS) message to/from another communicable device, or other similar and/or suitable radio signals.

The WLAN module 424 may connect to the Internet at a place where a wireless Access Point (AP) is installed under the control of the controller 410. The short-range communication module 426 may perform wireless short-range communication between the mobile station 400 and an external device under the control of the controller 410. The short-range communication may be and/or include at least one of Bluetooth, Zigbee, Infrared Data Association (IrDA), NFC, a smart card, and Radio Frequency Identification (RFID). The short-range communication is a technique of transmitting and receiving a small amount of data in a contact/non-contact fashion. Specifically, the short-range communication module 426 may include a tag reader (not shown) for detecting and reading signals from a Radio Frequency (RF) tag for short-range communication.

The display module 460 may be implemented as a touch screen to display information about various applications, e.g., a call, data transmission, broadcasting, and a camera application, that can be executed by the controller 410, and to provide user interfaces configured to be suitable for the applications. In this case, the controller 410 may select a soft key displayed on the touch screen 460 or may execute an application and/or function corresponding to a soft key, in response to a user's gesture sensed on the touch screen 460. The user's gesture may include a touch operation by the user's finger or by a pointing unit, body motion, and the like.

In the home network system configured as described above, the home gateway 400 may register information about home devices installed inside and/or outside a home, and may control and manage the registered home devices. For example, if a home device is newly installed, then the home gateway 400 may collect and store information about the home device, for example, an identifier, capacity information, and state information of the home device. The information about the home device may be acquired directly from the home device through a service discovery procedure between the home gateway 400 and the home device, may be received by the home gateway 400 from a server on the Internet based on identification information provided from the home device, or may be input to the home gateway 400 by a user or a system administrator. For example, if a user purchases and installs a new home device, and inputs identification information, e.g., a serial number, a model number, or a Quick Response (QR) code, provided through the home device or an instruction manual to the home gateway 400, then the home gateway 400 may connect to a manufacturer server on the Internet based on the identification information to acquire information about the home device.

Figure 5:
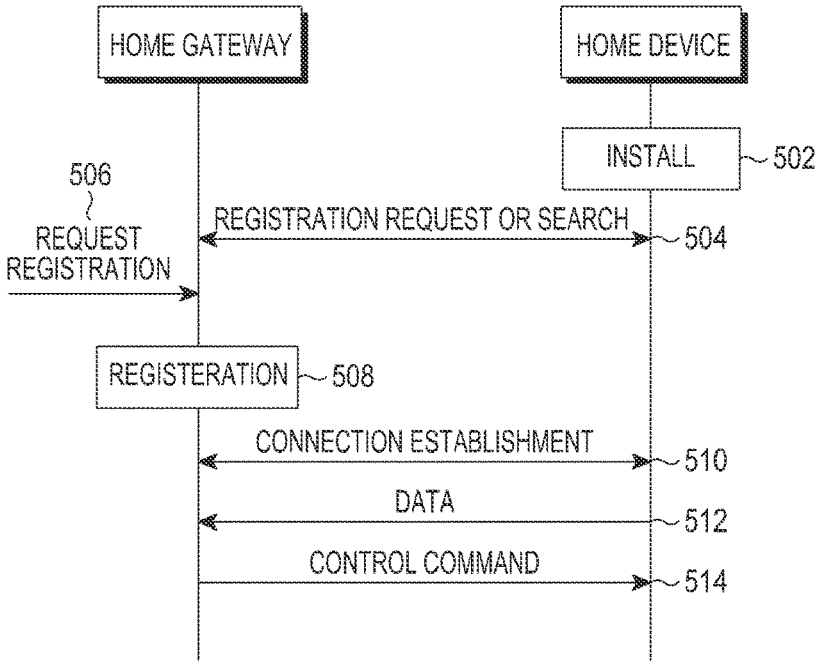
FIG. 5 is a flowchart of a procedure of registering a home device according to an embodiment of the present disclosure.

FIG. 5 is a flowchart of a procedure of registering a home device according to an embodiment of the present disclosure.

Referring to FIG. 5, a home device may be installed and powered on in operation 502. Alternatively, a user may try to register an already installed home device to a home gateway. Then, the home gateway may search for the home device or a registration request may be exchanged in operation 504. For example, if the home device is connected to the home gateway through WiFi, then the home gateway may perform a procedure of searching for a new device around the home gateway periodically or according to a request from a user. If the home gateway detects a new home device through the search procedure, the home gateway may receive information about the home device from the home device. The information about the home device may include at least one of an identifier, capacity information, and state information of the home device. For example, if the home device is an air conditioner, then the capacity information may include a temperature control range of the air conditioner, functions, such as air-conditioning, blasting, dehumidification, etc., supportable by the air conditioner, and an air volume control range, and the state information may include a location at which the air conditioner is installed.

According to an embodiment, the home gateway may receive a request for registering the home device from a user through a user interface of the home gateway, through a control console connected by an external interface, or through a computer on the Internet, and may receive information about the home device from the user, in operation 506. According to another embodiment, the home gateway may acquire identification information and/or state information of the home device from the home device or from the user, and may connect to a manufacturer server on the Internet based on the identification information to acquire capacity information of the home device.

Thereafter, the home gateway may store the information about the home device, and may manage the home device as a registered home device in operation 508. According to an embodiment, the home gateway may receive additional information about the home device from the user or from a remote terminal (that is a control station or a remote station) through the Internet or WiFi. The additional information may include at least one of a name or nickname of the home device, and a location at which the home device is installed.

According to another embodiment, the home gateway may receive additional information about a mode and/or authority of the home device from the user or from a remote terminal through the Internet or WiFi. The additional information may include a level of authority of access to the home device. The level of access authority may be a level of allowing access only through the home gateway, a level of allowing access by a registered remote terminal, or a level of allowing access by a remote terminal registered in the home gateway.

Thereafter, the home gateway may establish a connection to the home device in operation 510. The home gateway may connect to the home device according to a predetermined procedure defined in a communication technique, e.g., WiFi, Zigbee, Bluetooth, NFC, or wired communication, between the home gateway and the home device. If the home gateway connects to the home device, then the home device may transmit data to the home gateway, in operation 512. According to an embodiment, if the home device is a security camera or an electronic appliance having a security camera function, then the home device may transmit photographed image data to the home gateway in real time or according to a request from the home gateway. Also, the home gateway may transmit a control command to the home device, in operation 514. For example, if the home device is an air conditioner, then the home gateway may transmit a control command for adjusting a temperature, a control command for adjusting an air volume, and/or a control command for selecting a function, to the air conditioner, and the air conditioner may operate in response to the control command. The control command may include a desired temperature, desired air volume, an operating time, and a reservation time. According to a communication technique, the home device may inform the home gateway of the results of execution of the control command.

In a home network system, a user may register a Personal Computer (PC) or a mobile station for a remote control in the home gateway, and the home gateway may restrictively allow a remote control by the registered PC or mobile station. For example, a user may register a mobile station that is to be used for a remote control, through a mobile communication network or WiFi, or may manually register the mobile station, in the home gateway, and the home gateway may receive and store information about the mobile station, for example, an identifier, remote control authority, and a user mode of the mobile station. The information about the mobile station may be acquired directly from the mobile station through a connection between the home gateway and the mobile station, may be received by the home gateway from a server of a wireless communication system based on identification information provided from the mobile station, or may be input to the home gateway directly by a user or a system administrator.

Figure 6:
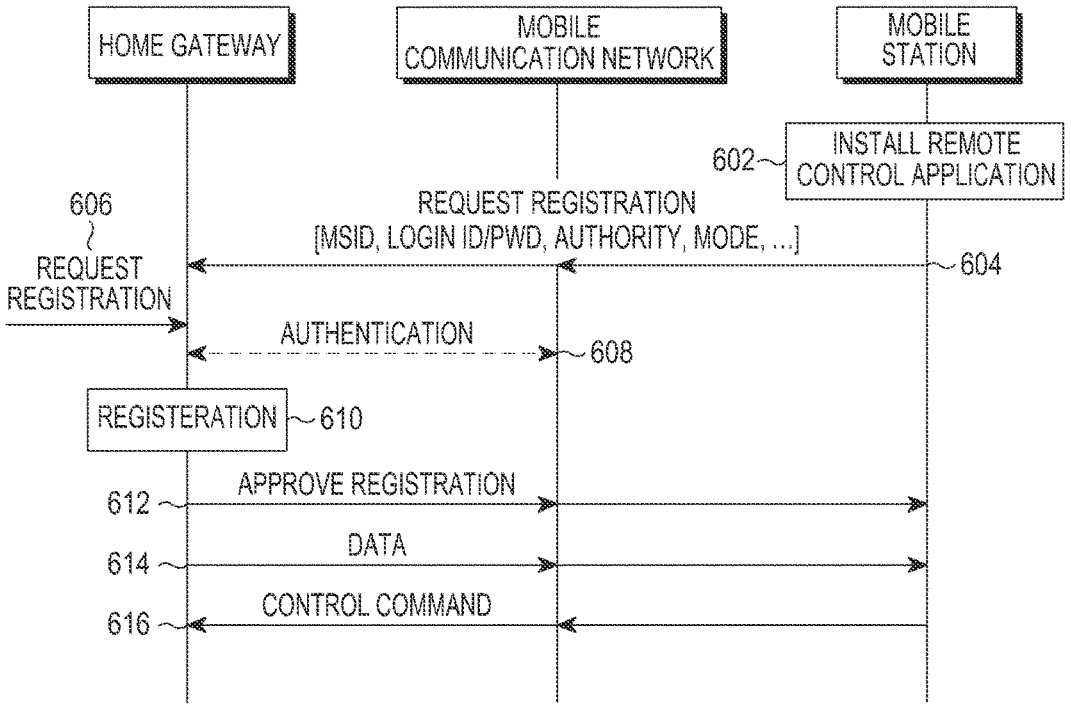
FIG. 6 is a flowchart of a procedure of registering a mobile station according to an embodiment of the present disclosure.

FIG. 6 is a flowchart of a procedure of registering a mobile station according to an embodiment of the present disclosure.

Referring to FIG. 6, a mobile station may install a remote control application, which may be referred to as an application, that supports a control of a home network system, in operation 602. According to an embodiment, the remote control application may be installed only in a mobile station of a user on which authentication is successful. For example, a home gateway may provide an authentication number, and at least one of the home gateway, a manufacturer server of the home gateway, or a server of providing the remote control application may allow only a mobile station of a user, who has input the authentication number, to download the remote control application. According to an embodiment, the remote control application may limit functions according to a level of authority of the mobile station. For example, the remote control application may selectively provide at least one function among an information inquiry through the home gateway, a receiving of an alarm from the home gateway, a partial control of home devices, and an overall control of home devices, according to a level of authority of the mobile station.

The mobile station may execute the remote control application, and may transmit a registration request message to the home gateway through the remote control application, in operation 604. The registration request message may be transferred to the home gateway through the Internet, through WiFi or through any other similar and/or suitable communication method. The registration request message may include at least one of an identifier, e.g., a Mobile Station IDentifier (MSID) or an International Mobile Subscriber Identify (IMSI), a log-in ID, a log-in password, authority information, and mode information of the mobile station. The authority information represents a level of authority of access to the home network system, and may include allowing of an information inquiry through the home gateway, allowing of reception of an alarm from the home gateway, allowing of a partial control of home devices, and allowing of an overall control of home devices.

According to an embodiment, the home gateway may receive a request for registering the mobile station from a user through a user interface of the home gateway, through a control console connected by an external interface, or through a computer on the Internet, and may receive information, e.g., authority information and/or mode information, about the mobile station from the user, via the request for registering the mobiles station in operation 606.

According to an embodiment, the home gateway may connect to a subscriber server of a mobile communication network based on identification information of the mobile station acquired from the mobile station or from the user, thereby authenticating the mobile station, in operation 608. If no authority information of the mobile station is input, then the home gateway may create authority information of the mobile station according to the result of the authentication.

Thereafter, the home gateway may store the information about the mobile station, and may manage the mobile station as a registered mobile station according to the registration performed in operation 610. Next, the home gateway may transmit a registration approval message, notifying that the information about the mobile station has been successfully registered and that the registration is approved, to the mobile station, in operation 612.

Thereafter, the home gateway may transmit data used for a remote control to the mobile station as necessary, in operation 614. According to an embodiment, the home gateway may transmit video data, recorded by at least one security camera installed inside and/or outside the home, to the mobile station in real time, periodically, or according to an event-trigger. According to an embodiment, the home gateway may transmit state information of lighting devices installed inside/around the home, power consumption information, and door opening/closing information to the mobile station in a real time, periodically, or according to an event-trigger. The mobile station may transmit a control command, for controlling the home gateway or at least one home device, to the home gateway as necessary, in operation 616. For example, the mobile station may request the home gateway to transmit video data recorded by a security camera, positioned at a specific location, in real time. According to an embodiment, the mobile station may instruct an air conditioner to work or stop working, through the home gateway.

In the home network system configured as described above, a user who is located outside the home network system may connect to the home gateway using his/her mobile station to control home devices located in the home network system. When a user goes out of a home, the user must perform a plurality of behaviors, such as turning off lighting devices of each room, turning off a TV and an air conditioner, and turning on a security camera. Also, when the user comes home, the user must perform a plurality of behaviors, such as turning on lighting devices of a desired room, turning on the TV and the air conditioner, and turning off the security camera.

In an embodiment of the present disclosure which will be described below, when away from home, when coming home, or when pre-determined operation conditions requiring a control of a plurality of home devices are satisfied, then the plurality of home devices are controlled at once to perform predetermined functions.

The pre-determined operation conditions may be classified into user triggering and system triggering.

The user triggering operation conditions include a case in which a user connects to the home gateway through the Internet using a remote terminal, such as a mobile station or a PC, and requests the home gateway to control groups of designated home devices from among home devices registered in the home network system.

The system triggering operation conditions include a case in which the home gateway senses movement of built-in entity installed in a registered mobile station or a registered vehicle and controls groups of a plurality of home devices designated for an operation mode corresponding to a type of the movement, and a case in which the home gateway controls groups of a plurality of home devices designated for a requested operation mode in response to a request from a remote terminal.

Figure 7:
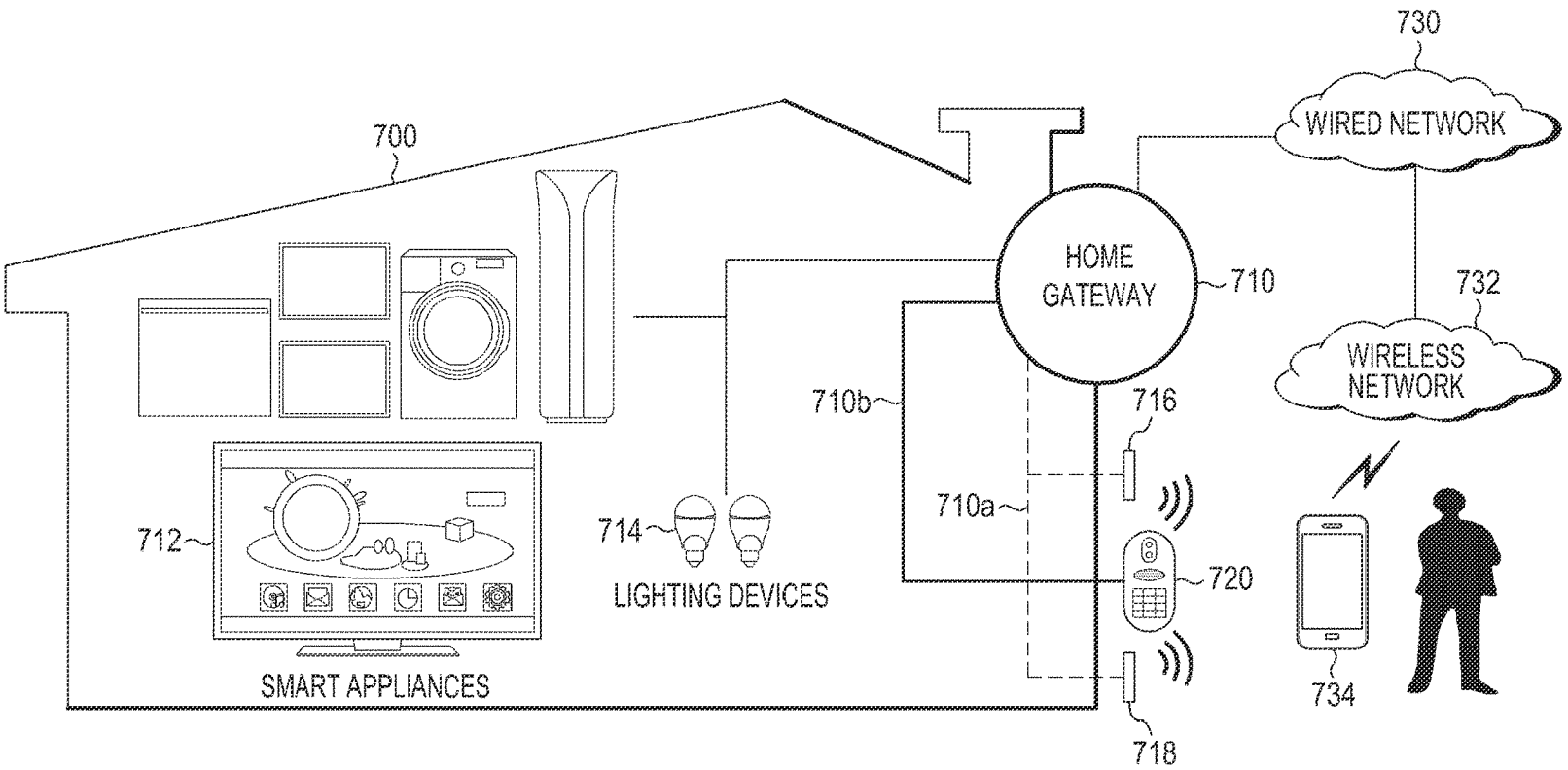
FIG. 7 illustrates a simplified configuration of a home network system for controlling groups of devices according to an embodiment of the present disclosure.

FIG. 7 illustrates a simplified configuration of a home network system for controlling groups of devices according to an embodiment of the present disclosure. In FIG. 7, a configuration for executing an away home mode and a coming home mode, as embodiments of operation conditions for controlling groups of home devices, is illustrated.

Referring to FIG. 7, a home network system 700 may include a home gateway 710, at least one home device 712 and 714, at least one RF tag, e.g., first and second RF tags 716 and 718, and a door lock 720 configured to transmit tag information configured with a unique identification number or text. The first and second RF tags 716 and 718 may be positioned around a front door, and may be used to trigger between the away home mode and the coming home mode. A mobile station 734 may sense each of the first and second RF tags 716 and 718 using a tag reader and may read out tag information from the RF tag 716 or 718. When the first and second RF tags 716 and 718 are positioned around a front door, in order to prevent the mobile station 734 from confusing tag information from the first RF tag 716 with tag information from the second RF tag 718, the tag reader may be configured to sense tag information when the mobile station 734 is within a very short distance, e.g., 10 cm, from the RF tag 716 or 718. Also, the RF tags 716 and 718 may be configured as a single RF tag. In this case, a home gateway or a mobile station connected to the RF tag may need additional processing. For example, if a mobile station that is currently in an away home state or in a coming home state is not managed, then it is impossible to determine whether a request from the mobile station is triggering to the coming home mode or to the away home mode since the same tag is used in both the away home mode and the coming home mode. Hereinafter, an example in which different tags are respectively used in the away home mode and the coming home mode will be described, however, the tags may be configured as a single tag as described above.

The first and second RF tags 716 and 718 may be implemented as smart cards or RFID tags that support unidirectional communication, or may communicate according to IrDA, NFC, Bluetooth, or Zigbee that supports bidirectional communication. If the RF tags 716 and 718 are RFID tags, then the tag reader of the mobile station 734 may perform unidirectional communication to read out tag information from one of the RFID tags 716 and 718, and the mobile station 734 may transmit a request message for executing an operation mode corresponding to the tag information to the home gateway 710 through a wireless network 732 and a wired network 730. The home gateway 710 may control the home devices 712 and 714 to perform functions designated for the corresponding operation mode, in response to the request message. To do this, the home gateway 710 may connect to the home devices 712 and 714 according to communication techniques corresponding to the home devices 712 and 714, and may transmit control commands to the home devices 712 and 714, respectively.

According to an embodiment, if the RF tags 716 and 718 are configured to perform bidirectional communication, then at least one of the RF tags 716 and 718 may sense a contact of the mobile station 734, and may transmit a request message to the home gateway 710 through a wired or wireless interface 710*a*. The request message may include an identifier of the corresponding RF tag 716 or 718. The home gateway 710 may determine an operation mode to be executed, based on the identifier of the RF tag 716 or 718. For example, if a request message including an identifier of the RF tag 716 is received, then the home gateway 710 may determine that the away home mode must be executed, and if a request message including an identifier of the RF tag 718 is received, then the home gateway 710 may determine that the coming home mode must be executed.

Hereinafter, an operation of executing the away home mode and the coming home mode using RF tags will be described in more detail.

Figure 8:
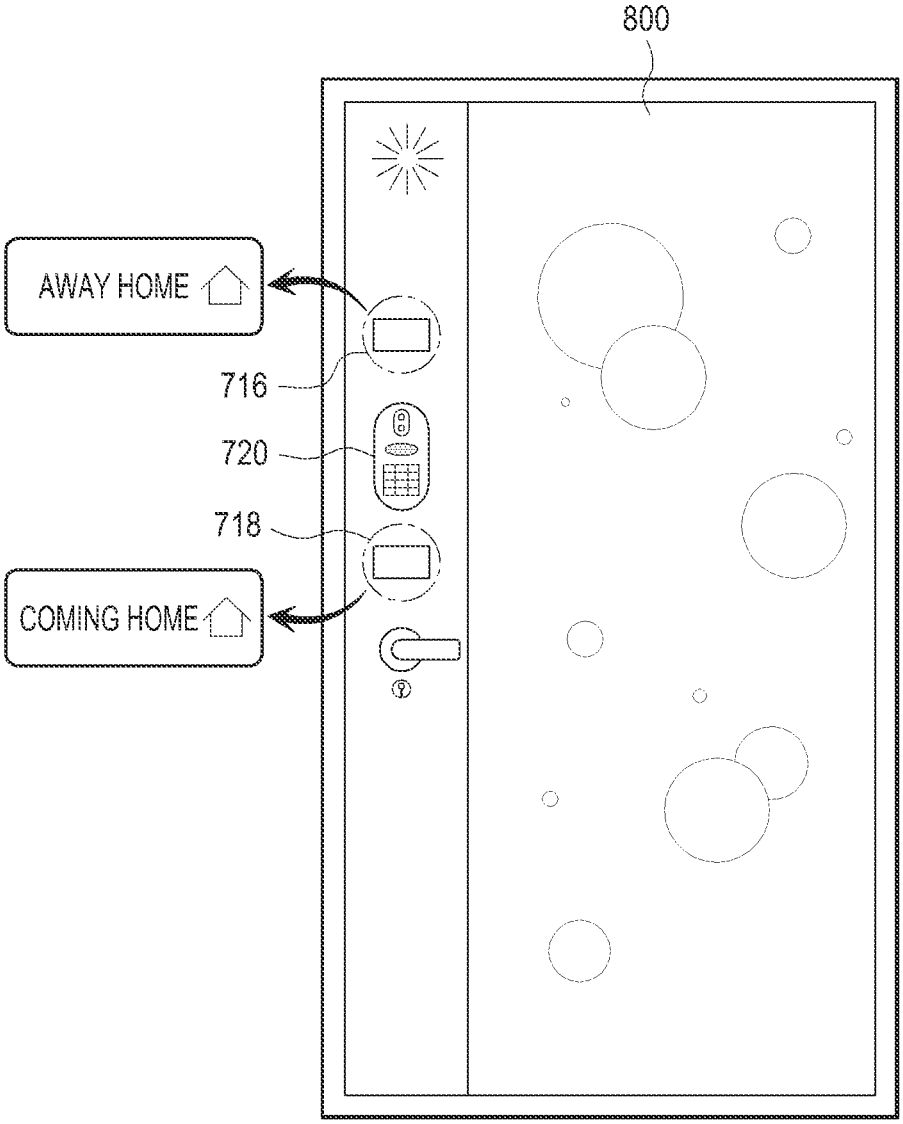
FIG. 8 illustrates Radio Frequency (RF) tags that are used to trigger between an away home mode and a coming home mode according to an embodiment of the present disclosure.

FIG. 8 illustrates RF tags that are used to trigger between the away home mode and the coming home mode according to an embodiment of the present disclosure. As illustrated in FIG. 8, a front door 800 includes a door lock 720 for receiving a signal, e.g., a password, body part recognition, an electronic key, or an electronic card, for opening the front door 800. For example, a first RF tag 716 for the away home mode may be located above the door lock 720, and a second RF tag 718 for the coming home mode may be located below the door lock 720, while being spaced by a predetermined distance apart from the first RF tag 716 in order to avoid signal interference with the first RF tag 716.

Referring to FIG. 8, an example in which the first and second RF tags 716 and 718 are located on the outside of the front door 800, so as to be around the door lock 720, is illustrated, however, the locations of the first and second RF tags 716 and 718 are not limited to this example. The first and second RF tags 716 and 718 may be disposed at arbitrary locations. For example, the first and second RF tags 716 and 718 may be respectively installed on the inside and outside of the front door 800. As another example, at least one of the first and second RF tags 716 and 718 may be installed on a wall around the front door 800.

Referring again to FIG. 7, the home gateway 710 may register information about the mobile station 734 and the home devices 712 and 714, and may manage states of the mobile station 734 and the home devices 712 and 714. Specifically, the home gateway 710 may store and manage at least one control list including identification information and function information of the home devices 712 and 714 designated according to an operation mode that can be requested by the mobile station 734. More specifically, the home gateway 710 may manage a control list for the away home mode, a control list for the coming home mode, and a control list for another operation mode. The control list for the away home mode may include identification information of home devices that are to be controlled when the away home mode is executed, and information about functions that are to be executed by the home devices, and the control list for the coming home mode may include identification information of home devices that are to be controlled when the coming home mode is executed, and information about functions that are to be executed by the home devices. The control list for the other operation mode may also be configured in the similar manner.

The home gateway 710 may read a control list corresponding to an operation mode requested by the mobile station 734, and may transmit control commands for executing functions designated by the corresponding control list to designated home devices 712 and 714, e.g., smart appliances and lighting devices, respectively. The control commands may further include commands for turning on/off the individual home devices 712 and 714, and information for additional functions, for example, a channel number of a TV and a desired temperature of an air conditioner. The control commands may be respectively transmitted to the home devices 712 and 714, or a control command may be broadcasted to all home devices in a home network. In the latter case, the control command may include information about home devices that are to operate and information about required operations, and each home device may read out the control command to perform a required operation.

In an embodiment, in the away home mode, smart appliances 712, such as a TV or an air conditioner, may be turned off, lighting devices 714, excluding a specific lighting device such as a lighting device at a front door, may be turned off, and security devices, such as an IP camera or the door lock 720, may be turned on. Meanwhile, in the coming home mode, the smart appliances 712, such as a TV or an air conditioner, may be turned on, designated lighting devices 714, such as a lighting device at a living room or a bedroom, may be turned on, and security devices, such as an IP camera or a door lock, may be turned off.

The home gateway 710 may receive the control lists from a user through a user interface of the home gateway 710, through a control console connected by an external interface, or through a computer on the Internet. Alternatively, the home gateway 710 may receive the control lists from the mobile station 734 or another remote terminal. The user may use predetermined basic control lists or may create, correct, or delete control lists of the home gateway 710 through the home gateway 710 or through a remote terminal, such as the mobile station 734. According to an embodiment, a plurality of different control lists may be created respectively for individual users. According to still another embodiment, a plurality of control lists for a user may be created.

The following Table 1 shows an example of a control list for the away home mode.

TABLE 1

| Away Home Mode | | | |
|---|---|---|---|
| Region | Home Device | Operation | Additional Function |
| Bedroom | TV | OFF | — |
| | Curtains | OFF | Fully Closed |
| Living Room | Audio | OFF | — |
| | Air Conditioner | OFF | |
| | Curtains | OFF | Fully Closed |
| Kitchen | Gas Valve | OFF | |
| Lighting devices | All Lighting devices | OFF | Dim Down |
| | Lighting device at Front Door | ON | 30% Dimming |
| Energy | All Heaters | OFF | |
| Security Device | IP Camera 1 | ON | |
| | IP Camera 2 | ON | |
| | Door Lock | ON | |

According to the control list shown in Table 1, when a request for executing the away home mode is received from the mobile station 734, the home gateway 710 may turn off a TV, an audio, an air conditioner, a gas valve, and all lighting devices, may fully close the curtains, and may turn on a front door LED, IP cameras, and the door lock 720. At this time, all lighting devices, except for the front door LED, may be dimmed down. Also, the home gateway 710 may set all heaters to the away home mode.

The following Table 2 shows an example of a control list for the coming home mode. In Table 2, control lists for individual users are shown.

TABLE 2

| Coming Home Mode | | | | |
|---|---|---|---|---|
| User | Region | Home Device | Operation | Additional Function |
| User 1 | Bedroom | TV | ON | CNN News (CH9), Greeting ON |
| | | Curtains | ON | Fully Opened |
| | Living Room | Audio | ON | CD Player |
| | | Air Conditioner | ON | Temp 25 |
| | | Curtains | ON | Fully Opened |
| | Lighting devices | Living Room 1 | ON | Dim Up |
| | | Bedroom 1 | ON | Dim Up |
| | Security Devices | All | OFF | |
| | Energy Devices | Living Room | ON | |
| User 2 | Bedroom | Curtains | ON | Fully Opened |
| | | Humidifier | ON | Humidity 60% |
| | Living Room | Audio | ON | Radio FM99.9 |
| | | Curtains | ON | Fully Opened |
| | Kitchen | Toaster | ON | Defrost Crispy |
| | | Oven | ON | Morning Roll |
| | | Washing Machine | ON | Standard Course |
| | Lighting Devices | Living Room 1 | ON | |
| | | Kitchen 1 | ON | Dim Up |
| | | Kitchen 2 | ON | Dim Up |
| | Security Devices | All | OFF | |
| | Energy Devices | Heater for Living Room | ON | Temp 25 |

Table 2 shows an example of control lists for individual users for the coming home mode. When a request for executing the coming home mode is received from a mobile station 734 registered as a user 1, then the home gateway 710 may turn on a TV, an audio, and an air conditioner, may fully open the curtains at a bedroom and a living room, may turn on designated lighting devices at the living room and the bedroom, and may turn off all security devices. For example, the TV may be turned on and automatically set to a designated channel, e.g., CH9, and the air conditioner may be turned on and automatically set to 25° C. Also, the lighting devices of the bedroom and the living room may be dimmed up. In addition, when the home gateway 710 senses a user of the mobile station 734, then the home gateway 710 may output a message, e.g., a voice message saying "Welcome Home, Father" or "Welcome Home, Alexander" or a screen displaying words such as "Welcome Home, Father" or "Welcome Home, Alexander", for the sensed user through the TV at the bedroom or the living room.

If a request for executing the coming home mode is received from the mobile station 734 registered as the user 2, then the home gateway 710 may turn on a humidifier, an audio, and a washing machine to perform predetermined operations, may preheat a toaster and an oven, may fully open the curtains at a bedroom and a living room, may turn on designated lighting devices of the living room, the bedroom, and a kitchen, and may turn off all security devices. The audio may be turned on and automatically set to receive a specific channel of a radio. Also, the designated lighting devices at the kitchen may be dimmed up, and the heater at the living room may be turned on.

Figure 9:
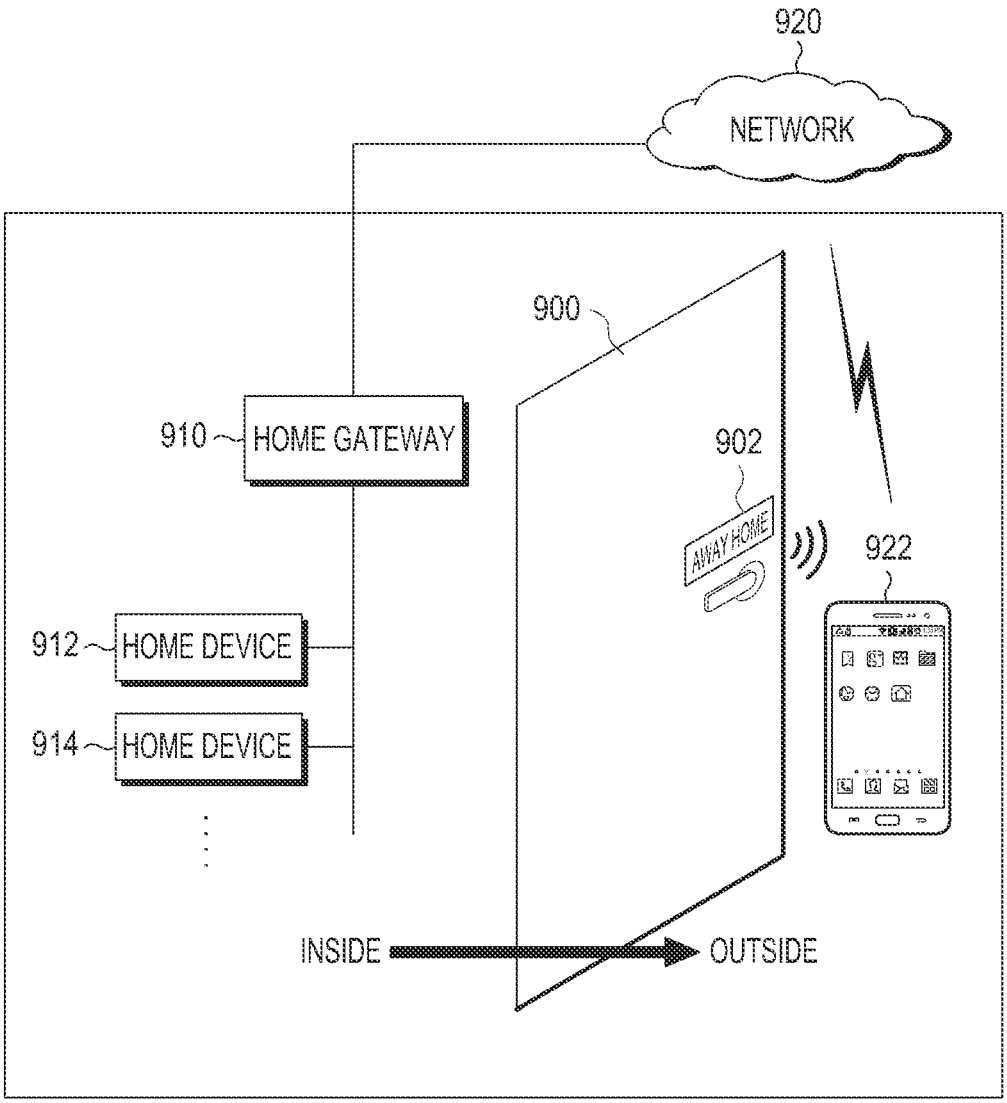
FIG. 9 is a view for describing operation of entering an away home mode according to an embodiment of the present disclosure.

FIG. 9 is a view for describing operation of entering an away home mode according to an embodiment of the present disclosure.

Referring to FIG. 9, if a user brings a mobile station 922 close to a RF tag 902 for the away home mode installed on a front door 900 when the user moves from the inside of a home to the outside of the home, that is, when the user goes out, then the mobile station 922 may read out unique tag information from the RF tag 902 through a tag reader installed in the mobile station 922. If the tag information is identical to pre-stored tag information designated for the away home mode, then the mobile station 922 may request a home gateway 910 to execute the away home mode through a network 920. The network 920 may include a wireless access network, a provider's core network, and the Internet. The home gateway 910 may control designated home devices 912 and 914 according to a control list for the away home mode, in response to the request from the mobile station 922.

Figure 10:
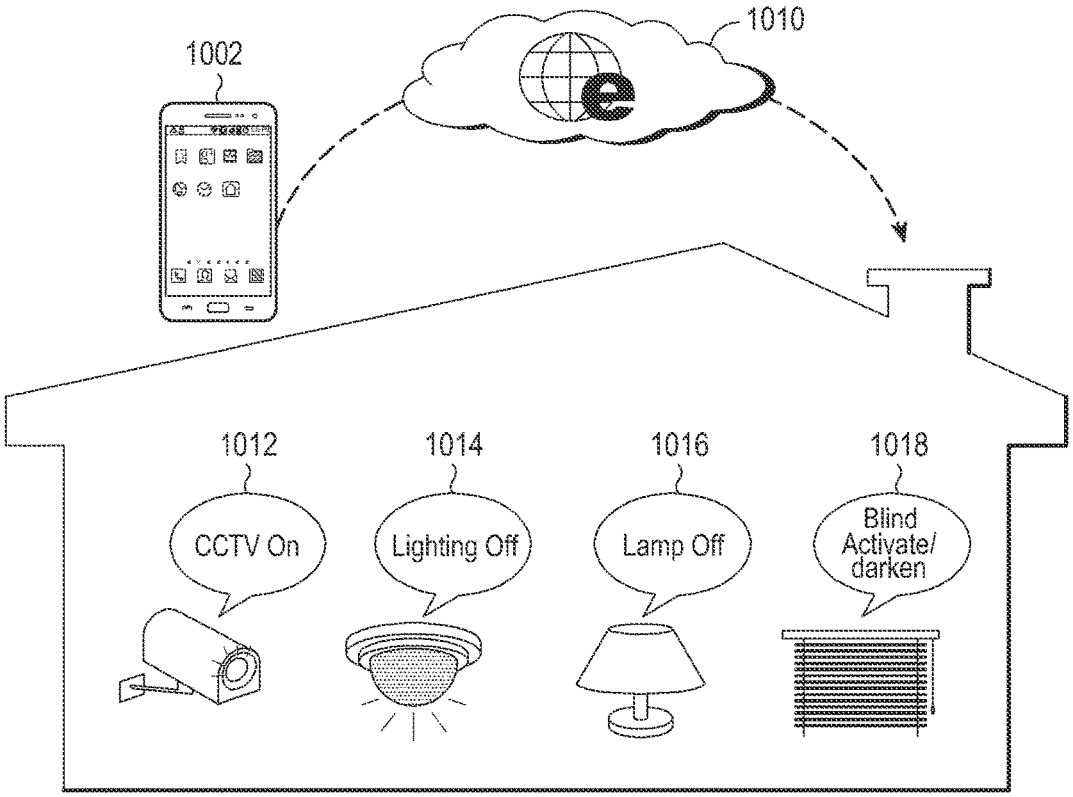
FIG. 10 illustrates a group control of home devices for an away home mode according to an embodiment of the present disclosure.

FIG. 10 illustrates a group control of home devices for an away home mode according to an embodiment of the present disclosure.

Referring to FIG. 10, if a mobile station 1002 requests execution of the away home mode through the Internet 1010, then a CCTV 1012 may be turned on, designated lighting devices and lamps 1014 and 1016 may be turned off, and a blind 1018 may be closed.

Figure 11:
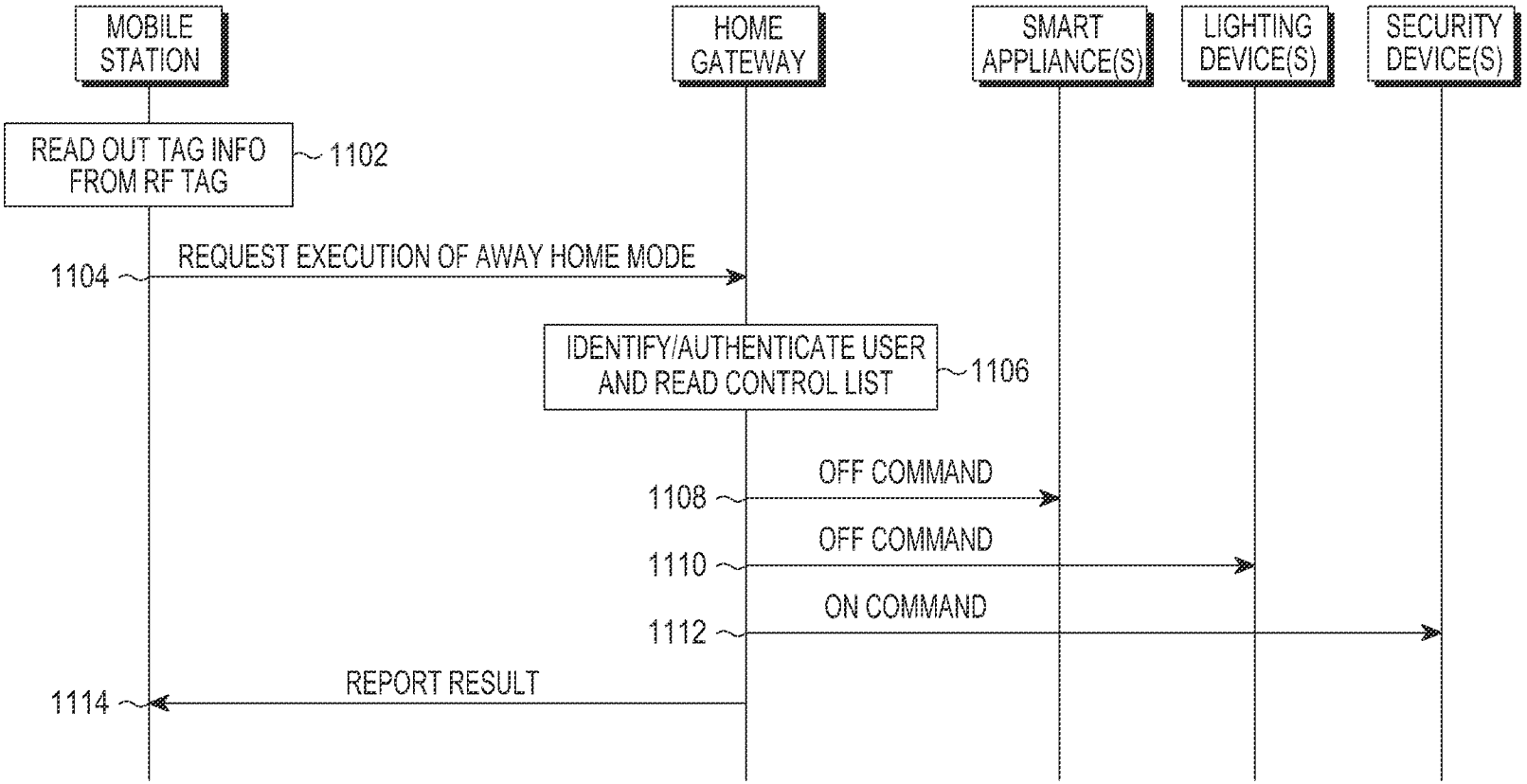
FIG. 11 is a flowchart of an operation in which an away home mode is executed according to an embodiment of the present disclosure.

FIG. 11 is a flowchart of an operation in which an away home mode is executed according to an embodiment of the present disclosure.

Referring to FIG. 11, a mobile station may read out tag information from a RF tag through a tag reader, in operation 1102. If the tag information is identical to pre-stored tag information designated for the away home mode, then the mobile station may transmit a request message for executing the away home mode to a home gateway through the Internet, in operation 1104. The request message may have a format according to an interface provided between the mobile station and the home gateway, and the request message may include an identifier of the mobile station and an indicator indicating the away home mode.

Then, the home gateway may identify and authenticate the mobile station in response to the request message, and may read a control list for the away home mode stored for a user of the identified mobile station, in operation 1106. More specifically, the home gateway may determine whether the mobile station has been already registered and whether the mobile station has authority for executing the away home mode. If the mobile station has been already registered and has authority for executing the away home mode, then the home gateway may search for a control list for the away home mode stored for the mobile station. If no control list for the away home mode stored for the mobile station is found, then the home gateway may operate based on a default control list or may report execution failure of the away home mode to the mobile station, according to a predetermined operation. In contrast, if a control list for the away home mode stored for the mobile station is found, then the home gateway may control home devices included in the control list to execute designated functions, such as ON/OFF commands, or any other similar and/or suitable functions, in operations 1108, 1110, and 1112.

According to an embodiment, the home gateway may report the execution results of the away home mode to the mobile station, in operation 1114. For example, if a specific home device is in a deactivated state, that is, if a failure occurs in a specific home device or a specific home device is turned off so as to be out of control, then the home gateway may notify the mobile station that the home device was not controlled. The mobile station may display the execution results of the away home mode on a screen, in response to the notification from the home gateway. The execution results may be states of the individual home devices. According to an embodiment, the home gateway may notify at least another registered mobile station, other than the mobile station that has requested execution of the away home mode, that the away home mode has been executed. In this case, the home gateway may notify the other registered mobile station of information, e.g., a user name, about the mobile station that has requested execution of the away home mode.

Figure 26:
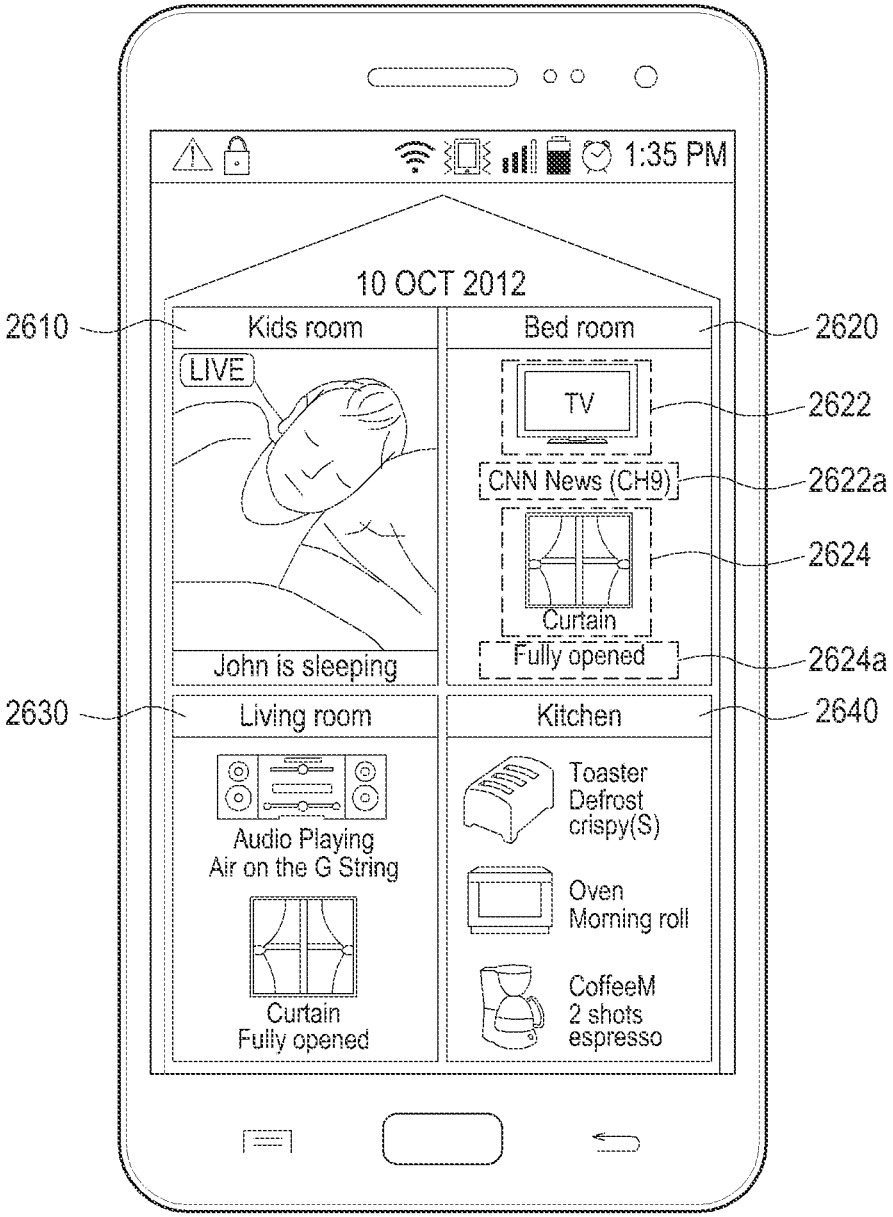
FIG. 26 illustrates a graphics-type control list menu according to an embodiment of the present disclosure.

The execution results of the away home mode may be displayed on the mobile station through a screen as illustrated in FIG. 26.

As illustrated in FIG. 26, if the execution results of the away home mode are received, then the mobile station may display identification information of home devices registered in a home network system and states of the home devices on a screen. For example, the mobile station may display a symbol, e.g., text or a small image, of a TV, and displays a text indicator, e.g., "CNN News (CH9)", indicating a current state of the TV. As another example, a symbol of the curtains may be displayed as a window-shaped small image including fully opened curtains, together with a text indicator "Fully opened". A user may determine whether functions corresponding to a requested operation mode have been normally executed by the corresponding home devices, through the screen as illustrated in FIG. 26. According to an embodiment, symbols and states of the home devices may be classified and arranged according to regions, e.g., a bedroom, a living room, a kitchen, a balcony, and a front door, sectioned in a home.

Figure 12:
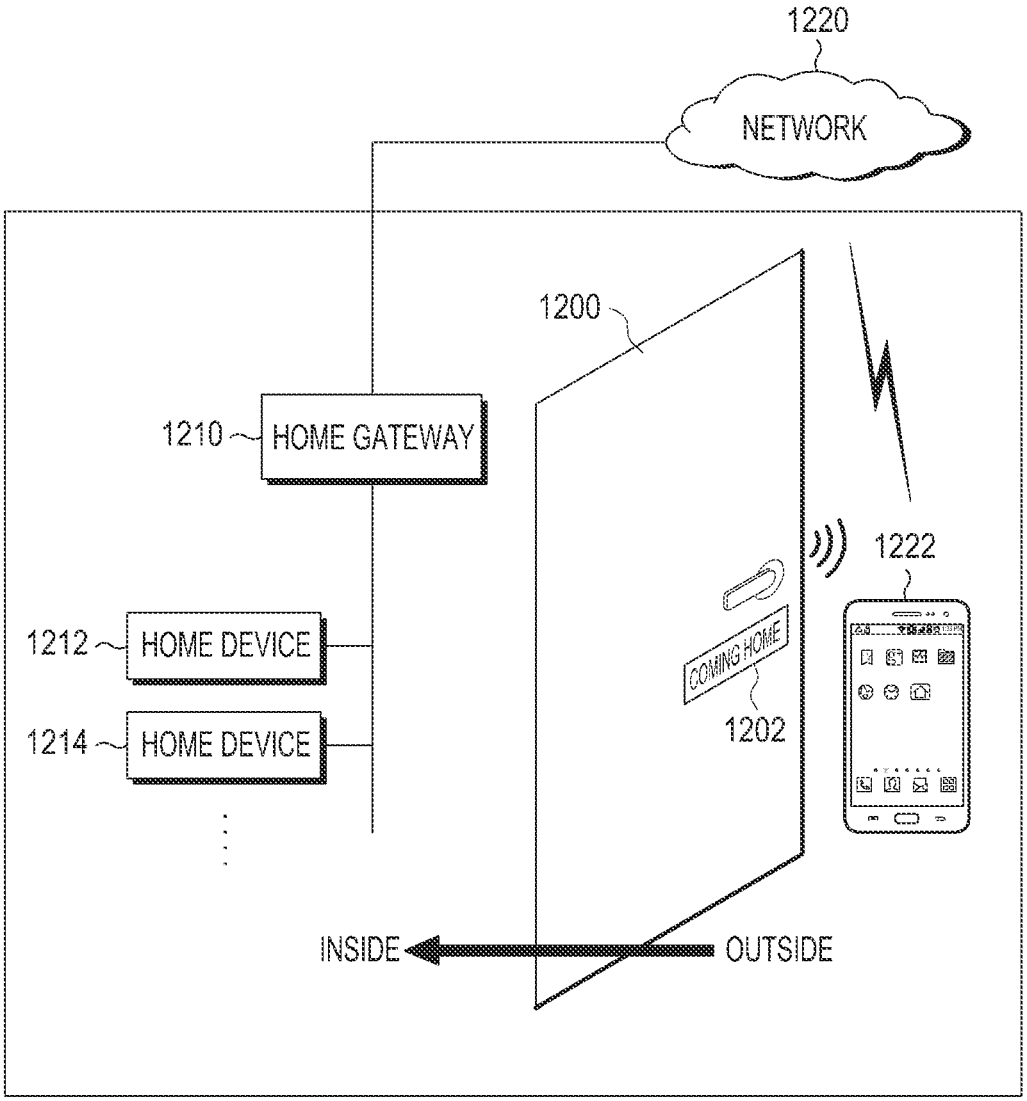
FIG. 12 is a view for describing operation of entering a coming home mode according to an embodiment of the present disclosure.

FIG. 12 is a view for describing operation of entering a coming home mode according to an embodiment of the present disclosure.

Referring to FIG. 12, if a user brings a mobile station 1222 close to a RF tag 1202 for the coming home mode, the RF tag 1202 being installed on a front door 1200, when the user moves from the outside of a home to the inside of the home, (that is, when the user comes home, the mobile station 1222 may read out unique tag information from the RF tag 1202 through a tag reader. If the tag information is identical to pre-stored tag information designated for the coming home mode, then the mobile station 1222 may request a home gateway 1210 to execute the coming home mode through a network 1220. The home gateway 1210 may control designated home devices 1212 and 1214 according to a control list for the coming home mode, in response to the request from the mobile station 1222.

Figure 13:
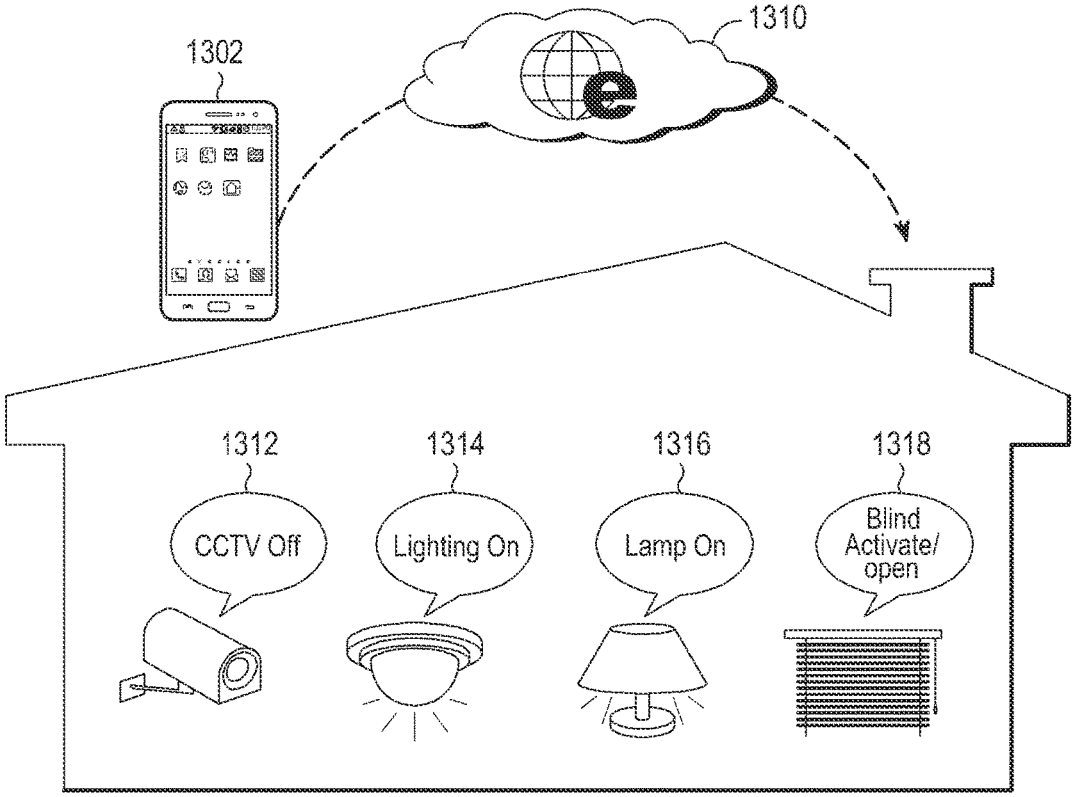
FIG. 13 illustrates a group control of home devices for a coming home mode according to an embodiment of the present disclosure.

FIG. 13 illustrates a group control of home devices for the coming home mode according to an embodiment of the present disclosure.

Referring to FIG. 13, if a mobile station 1302 requests execution of the coming home mode through the Internet 1310, then a CCTV 1312 is turned on, designated lighting devices and lamps 1314 and 1316 are turned on, and blinds 1318 are opened.

Figure 14:
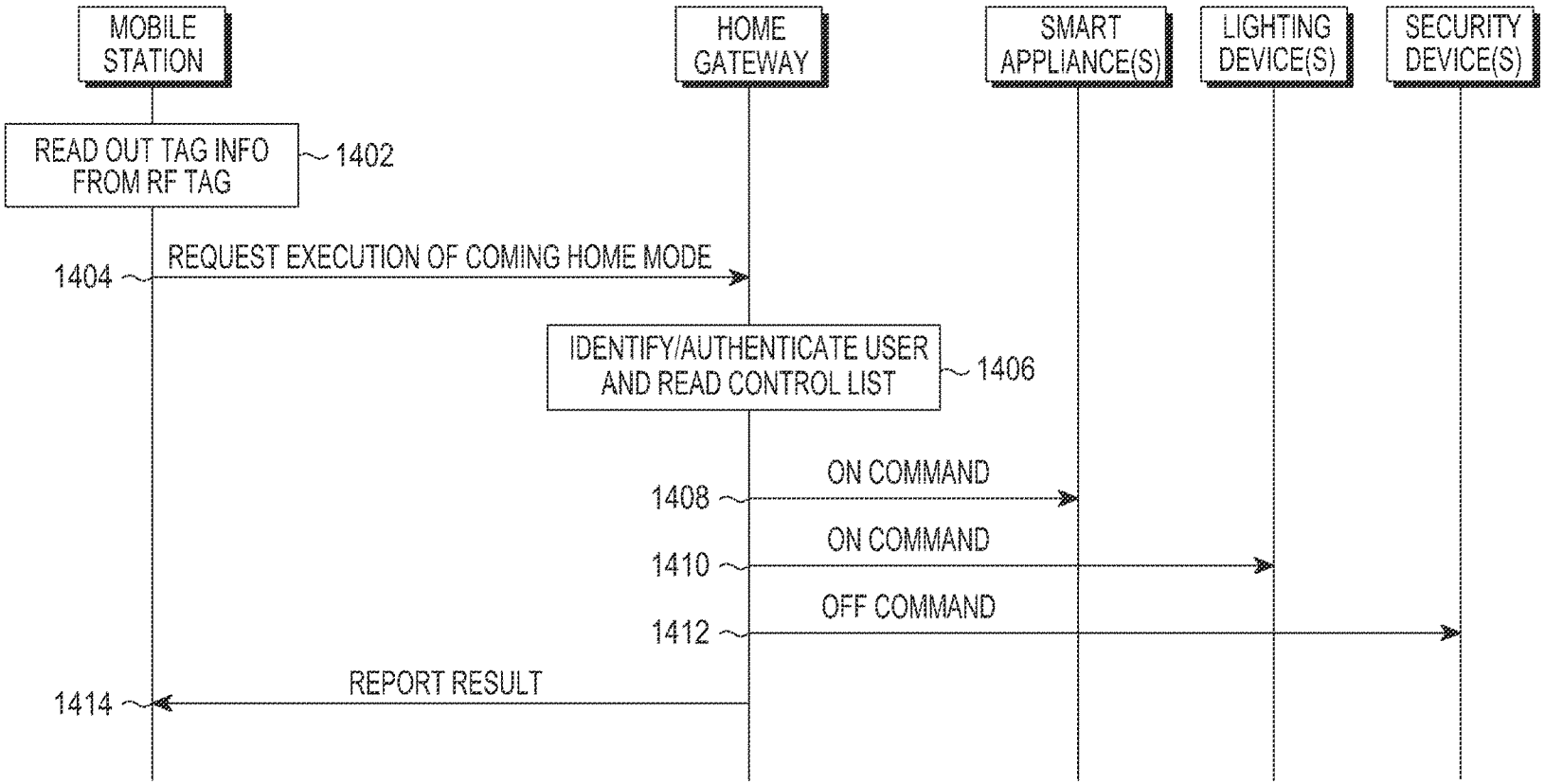
FIG. 14 is a flowchart of an operation in which a coming home mode is executed according to an embodiment of the present disclosure.

FIG. 14 is a flowchart of an operation in which a coming home mode is executed according to an embodiment of the present disclosure.

Referring to FIG. 14, a mobile station may read out tag information from an RF tag through a tag reader installed in the mobile station, in operation 1402. If the tag information is identical to pre-stored tag information designated for the coming home mode, then the mobile station may transmit a request message for executing the coming home mode to a home gateway through the Internet, in operation 1404. The request message may include an identifier of the mobile station and an indicator indicating the coming home mode.

Then, the home gateway may identify and/or authenticate the mobile station, in response to the request message, and may read a control list for the coming home mode stored for a user of the mobile station, in operation 1406. If the mobile station has been already registered in the home gateway and has authority for executing the coming home mode, then the home gateway may search for a control list for the coming home mode stored for the mobile station. If no control list for the coming home mode stored for the mobile station is found, then the home gateway may operate based on a default control list or may report execution failure of the coming home mode to the mobile station, according to a predetermined operation. In contrast, if a control list for the coming home mode stored for the mobile station is found, then the home gateway may control home devices included in the control list to execute designated functions, such as ON/OFF commands, or any other similar and/or suitable functions, in operations 1408, 1410, and 1412.

According to an embodiment, the home gateway may report the execution results of the coming home mode to the mobile station that has requested execution of the coming home mode and/or at least another registered mobile station in operation 1414. The other mobile station may display the execution results of the coming home mode, and a user name of the mobile station that has requested execution of the coming home mode, on a screen, in response to the report from the home gateway. The execution results of the coming home mode may be states of the individual home devices. The execution results of the coming home mode may be displayed on the mobile station through a screen as illustrated in FIG. 26.

According to an embodiment, the home gateway may notify another registered mobile station, instead of the mobile station that has requested execution of the coming home mode, that the coming home mode has been executed. In this case, the home gateway may notify the other registered mobile station of information, e.g., a user name, about the mobile station that has requested execution of the coming home mode.

Figure 15:
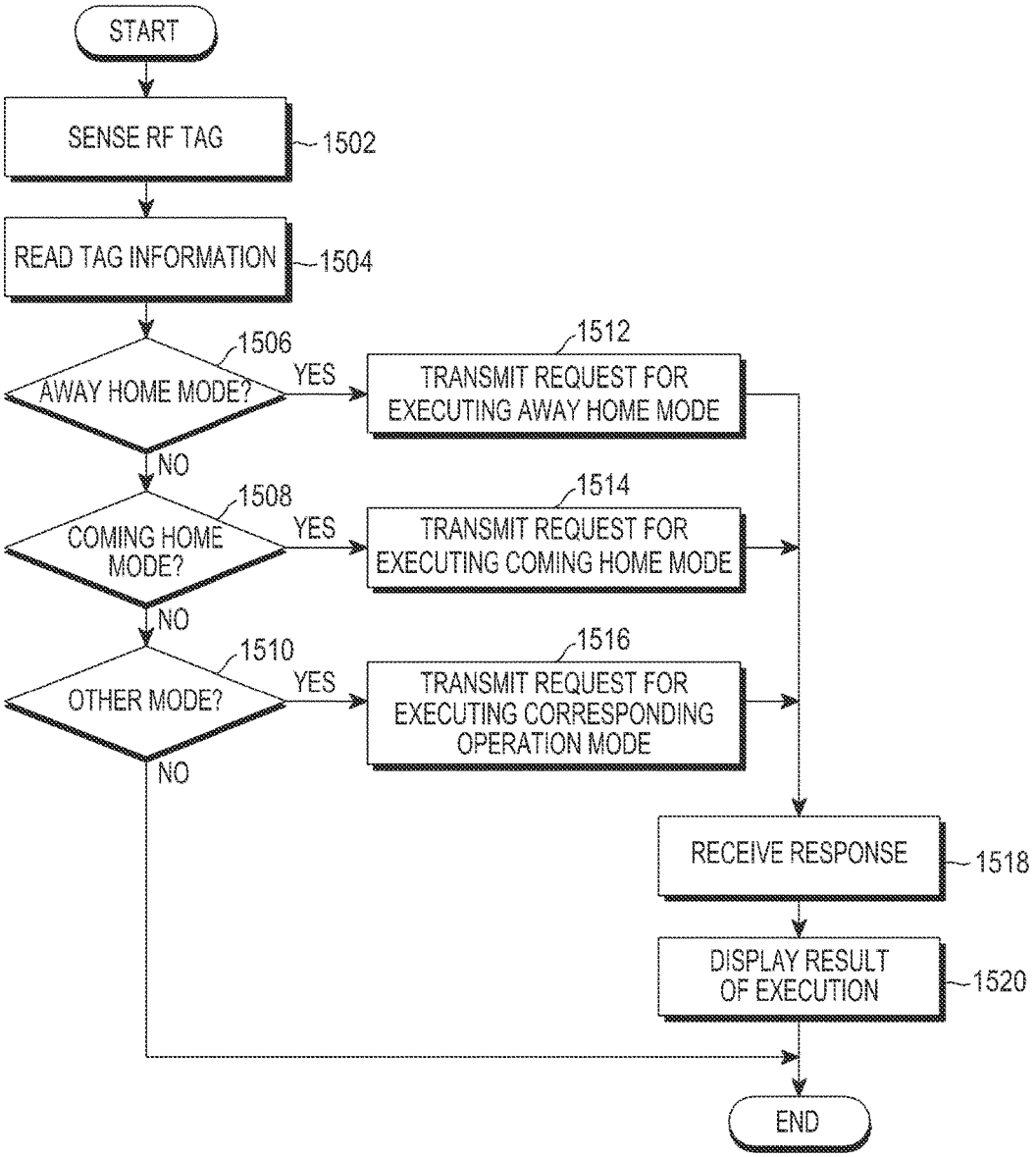
FIG. 15 is a flowchart of an operation of a mobile station according to an embodiment of the present disclosure.

FIG. 15 is a flowchart of an operation of a mobile station according to an embodiment of the present disclosure. The mobile station may be implemented as a control station or a remote station.

Referring to FIG. 15, a mobile station may sense a RF tag in operation 1502, and may read tag information from the RF tag in operation 1504. Then, the mobile station determines whether the tag information corresponds to the away home mode in operation 1506. If the tag information corresponds to the away home mode, then the mobile station may transmit a request message for executing the away home mode to a home gateway through a network, in operation 1512. Meanwhile, if the tag information does not correspond to the away home mode, then operation 1508 is executed to determine if the tag information corresponds to the coming home mode, and if the tag information corresponds to the coming home mode, as determined in operation 1508, then the mobile station may transmit a request message for executing the coming home mode to the home gateway through the network, in operation 1514. If the mobile station, in operation 1508, determines that the tag information does not correspond to the coming home mode, then the mobile station determines whether the tag information corresponds to another defined operation mode in operation 1510, and if the tag information corresponds to another defined operation mode, then the mobile station may transmit a request message for executing the corresponding operation mode to the home gateway through the network, in operation 1516.

In one embodiment, the request message in the operation 1512, 1514 or 1516 comprises information indicating the operation mode. In an alternative embodiment, the request message comprises information (i.e., comprises macro-instructions) for instructing at least one home device associated with the operation mode, to execute one or more functions corresponding to the operation mode.

Thereafter, the mobile station may receive a response report representing the results of execution according to the request message, from the home gateway, in operation 1518. Then, the mobile station may display the results of the execution on a screen, in operation 1520.

According to an embodiment, the home gateway may store the execution results of an operation mode and/or an execution time of the operation mode whenever the operation mode is executed, and may provide the execution results of the operation mode and/or the execution time of the operation mode according to a request from a user. For example, the home gateway may store a user name, a requested operation mode, the execution results of the operation mode, and an execution time of the operation mode when the home gateway senses the user's outing and coming home, as shown in Table 3, below.

TABLE 3

| User | Operation | Execution | Time |
|---|---|---|---|
| User 1 | Away Home | — | 2012.10.01 AM07:15 |
| User 3 | Away Home | — | 2012.10.01 AM08:03 |
| User 4 | Away Home | — | 2012.10.01 AM08:10 |
| User 2 | Away Home | Execution | 2012.10.01 AM10:47 |
| User 2 | Coming Home | Execution | 2012.10.01 PM04:35 |
| User 4 | Coming Home | — | 2012.10.01 PM05:24 |
| User 3 | Coming Home | — | 2012.10.01 PM08:21 |
| User 1 | Coming Home | — | 2012.10.01 PM09:01 |
| . | . | . | . |
| . | . | . | . |
| . | . | . | . |
| User 1 | Coming Home | Execution | 2012.10.30 PM07:38 |

According to an embodiment, when a request for executing the away home mode or the coming home mode is received, then the home gateway may accept or ignore the request selectively. According to an embodiment, if the user 2 is at home when the user 1 has issued a request for executing the away home mode, then the home gateway may ignore the request for executing the away home mode from the user 1. For example, if no request for executing the away home mode is received after the user 2 has requested execution of the coming home mode, then the home gateway may determine that the user 2 is at home. As another example, the home gateway may determine whether the user 2 has gone out based on location information of the user 2.

According to an embodiment, when a plurality of requests for executing the same operation mode are received from a plurality of users, then the home gateway may accept or ignore the requests selectively according to the users' authority levels. For example, when a request for executing the coming home mode is received from the user 4 having a lower authority level than the user 2, after the coming home mode is executed by the user 2, then the home gateway may ignore the coming home mode execution request from the user 4. As another example, if a request for executing the coming home mode is received from the user 1 having a higher authority level than the user 2, after the coming home mode is executed by the user 2, then the home gateway may preferentially accept the coming home mode execution request from the user 1.

In the embodiment in which the request message received from the mobile station comprises macro-instructions for instructing home devices associated with a specific operation mode, to execute functions corresponding to the operation mode, the home gateway may generate control commands for the home devices associated with the operation mode, and transmit the control commands to the respective home devices in response to receiving the request message.

Figure 16:
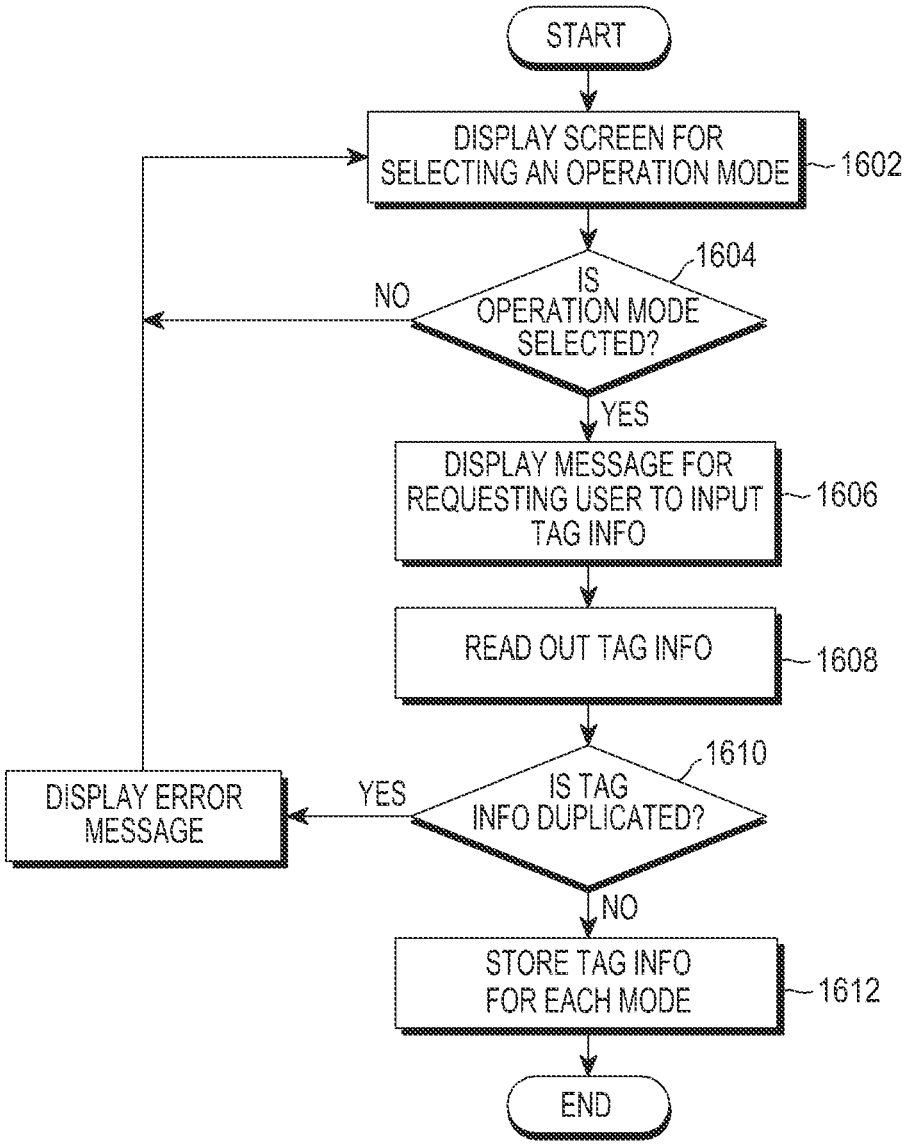
FIG. 16 is a flowchart of a procedure in which a mobile station inputs a tag to set an operation mode according to an embodiment of the present disclosure.

FIG. 16 is a flowchart of a procedure in which a mobile station inputs a tag to set an operation mode according to an embodiment of the present disclosure.

Referring to FIG. 16, a mobile station may display a screen for selecting an operation mode to allow a user to input tag information, in operation 1602. For example, the mobile station may display a list of an away home mode, a coming home mode, and a predetermined operation mode on a screen, and request a user to select a specific operation mode. Next, the mobile station determines, in operation 1604, if an operation mode is selected. If a specific operation mode, for example, the away home mode is selected in operation 1604, then the mobile station may display a message for requesting the user to input tag information for triggering to the selected operation mode on a screen, in operation 1606. For example, the mobile station may display guidance words "Please Make Your Device Contact a Tag for Away home Mode" on a screen so that the user makes the mobile station contact a RF tag that is to be used for the away home mode according to the guidance words.

Then, the mobile station may read out tag information from a RF tag through a tag reader installed in the mobile station, in operation 1608. The mobile station may determine whether the tag information is duplicated, or in other words identical, to tag information stored for another operation mode, in operation 1610, and if the tag information is identical to tag information stored for another operation mode, then the mobile station may display an error message notifying that the same tag information exists, on a screen, and returns to operation 1602 or, although not shown, the mobile station returns to operation 1608. In contrast, if the same tag information is not found, then the mobile station may store the tag information corresponding to the selected operation mode, or in other words, the mobile station may store tag information for each mode, in operation 1612, and terminate operation. At this time, words notifying that a tag for the away home mode has been successfully input may be displayed on the screen. The mobile station may receive tag information for another operation mode through the same procedure.

Meanwhile, according to an embodiment, referring again to FIG. 7, the home gateway 710 may sense a user's outing or coming home from the door lock 720 having a communication function through the wired or wireless interface 710*b*, and may execute an operation mode corresponding to the user's outing or coming home. Executing the away home mode/coming home mode by the door lock 720 may be useful in a home network system for single households.

That is, when a front door is opened from the inside, for example, when an open key installed on the inside of a front door is pressed, then the door lock 720 may transmit a request message for executing the away home mode to the home gateway 710 through the wired or wireless interface 710*b*. According to an embodiment, in order to distinguish a temporary outing from a long term outing, the door lock 720 may transmit the request message when a predetermined time period, for example 10 minutes, has elapsed after the front door has been opened from the inside. According to another embodiment, the home gateway 710 may execute the away home mode when a predetermined time period has elapsed after a request message for executing the away home mode has been received from the door lock 720. Also, when the door lock 720 is opened/released from the outside by at least one of supportable user authentication techniques, for example, inputting a password, inputting an electronic key, recognizing a Subscriber Information Module (SIM)/RF/NFC card, and recognizing a body part such as fingerprint/voice/iris/face, then the door lock 720 may transmit a request message for executing the coming home mode to the home gateway 710 through the wired or wireless interface 710*b*.

Figure 17:
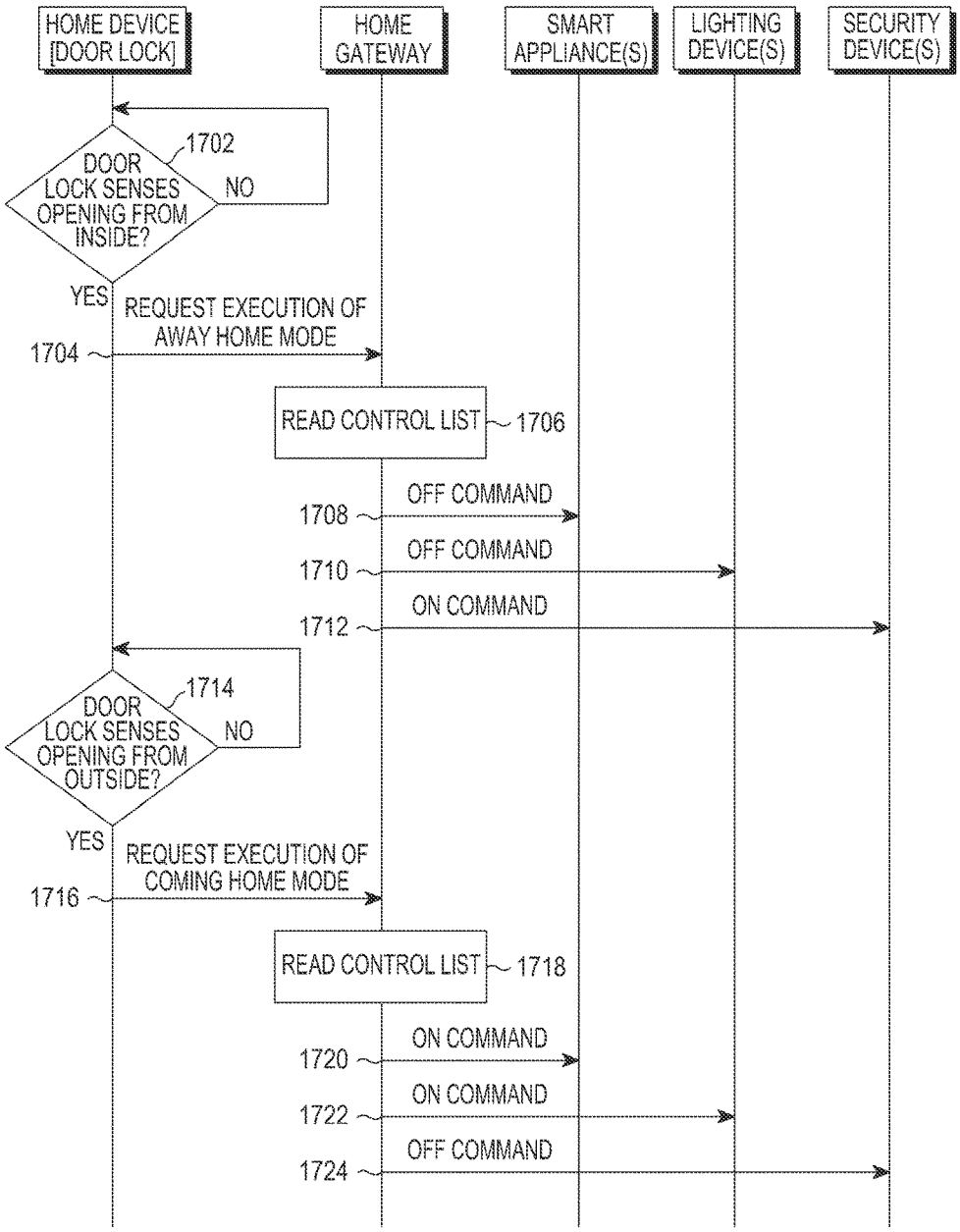
FIG. 17 is a flowchart of an operation for executing an away home mode and a coming home mode according to an embodiment of the present disclosure.

FIG. 17 is a flowchart of an operation for executing an away home mode and a coming home mode according to an embodiment of the present disclosure.

Referring to FIG. 17, it is determined whether a door lock senses opening from the inside, in 1702. Then, the door lock may transmit a request message for executing the away home mode to a home gateway through a wired or wireless interface, in operation 1704. Then, the home gateway may read a control list stored for the away home mode, in response to the request message, in operation 1706. For example, the control list may be designated such that the away home mode is executed by the door lock. Thereafter, the home gateway may control home devices included in the control list to execute designated functions, such as ON/OFF commands, or any other similar and/or suitable functions, in operations 1708, 1710, and 1712. For example, the home gateway may control designated smart appliances and designated lighting devices to be turned off, and may control security devices to be turned on. According to an embodiment, the home gateway may report the execution results of the away home mode to a registered mobile station, and the mobile station may display the execution results of the away home mode on a screen, in response to the report from the home gateway.

Thereafter, it is determined whether the door lock senses opening from the outside in operation 1714, and if the opening from the outside sensed, then the door lock may transmit a request message for executing the coming home mode to the home gateway through a wired or wireless interface, in operation 1716. Then, the home gateway may read a control list stored for the coming home mode in response to the request message, in operation 1718. For example, the control list may be designated such that the coming home mode is executed by the door lock. Thereafter, the home gateway may control home devices included in the control list to execute designated functions, such as ON/OFF commands, or any other similar and/or suitable functions, in operations 1720, 1722, and 1724. For example, the home gateway may control designated smart appliances and designated lighting devices to be turned on, and security devices to be turned off. According to an embodiment, the home gateway may report the execution results of the coming home mode to a registered mobile station, and the mobile station may display the execution results of the coming home mode on a screen, in response to the report from the home gateway.

Figure 18:
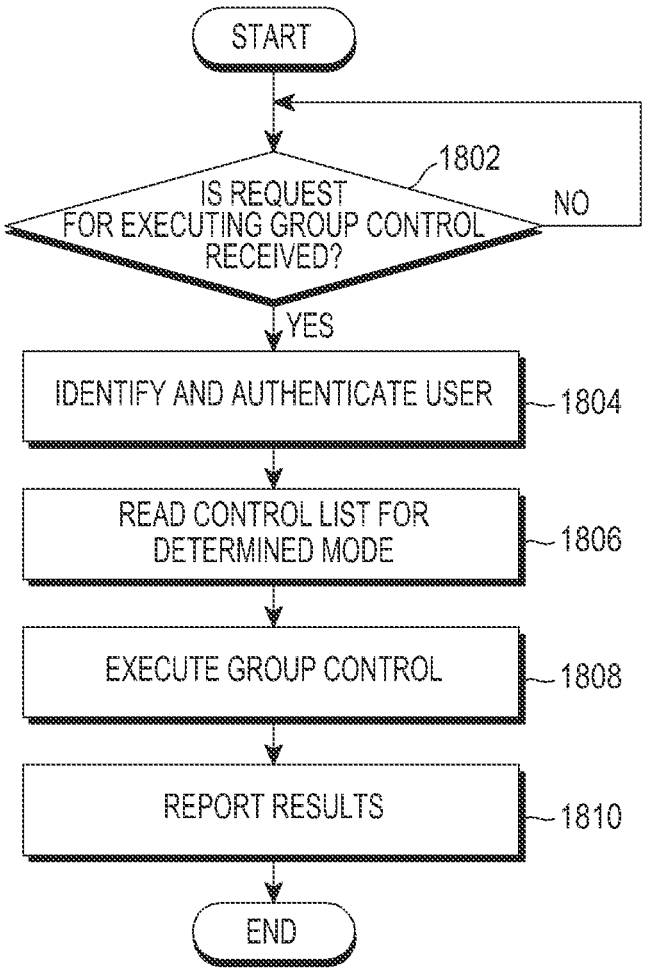
FIG. 18 is a flowchart of an operation in which a home gateway performs a group control according to an operation mode according to an embodiment of the present disclosure.

FIG. 18 is a flowchart of an operation of a home gateway that controls groups according to an operation mode according to an embodiment of the present disclosure.

Referring to FIG. 18, a home gateway may determine whether a request message for executing an operation mode for a group control is received, in operation 1802. More specifically, the home gateway may receive a request message for executing a specific operation mode from at least one of a mobile station, RF tags, and a door lock. Then, the home gateway may identify and authenticate a user who has transmitted the request message, in operation 1804. More specifically, if a request message for executing an operation mode for a group control is received through an external network, for example, through the Internet, then the home gateway may identify a remote terminal that has transmitted the request message, and may determine whether the remote terminal has been registered in the home gateway and whether the remote terminal has authority for executing a group control. If a user who has transmitted the request message does not need to be authenticated, for example, if the request message is received from the registered device in a home network system, for example, a door lock, then the authentication procedure of operation 1804 may be omitted.

Thereafter, the home gateway may determine an operation mode corresponding to the request message, and may read a control list for the determined operation mode, in operation 1806. For example, the home gateway may recognize a requested operation mode based on an operation mode identifier included in the request message received from a mobile station or a door lock. As another example, the home gateway may determine a requested operation mode based on a sender ID of the request message received from one of RF tags.

Thereafter, the home gateway may transmit control commands instructing home devices included in the control list to perform designated functions, for example, turning on/off, to the home devices, respectively, or in other words, the home gateway may execute group control of the home devices included in the control list, in operation 1808. Then, the home gateway may report the execution results of the operation mode to a registered mobile station, in operation 1810.

Operation in which the home gateway executes a group control according to a request from a mobile station or a specific device in a home network system has been described. The following embodiment relates to an operation in which the home gateway triggers to a group control for a specific operation mode according to its own determination. For example, the home gateway may monitor a location of a registered user's mobile station, and if the home gateway determines that the mobile station has moved within a predetermined range from a registered home, then the home gateway may execute a specific operation mode, for example, a coming home mode.

In an alternative embodiment, the home gateway may broadcast the request message to home devices in the home network system transparently. Then each home device may determine whether the home device is associated with the operation mode corresponding to the request message and executes the operation mode in response to receiving the request message, and executes one or more predetermined functions corresponding to the operation mode when it is determined that the home device is associated with the operation mode. For determining the one or more predetermined functions, each home device may store a list of one or more functions corresponding to at least one operation mode, and read the list in response to receiving the request message to determine whether to execute the operation mode or not and to determine one or more functions corresponding to the operation mode.

Figure 19:
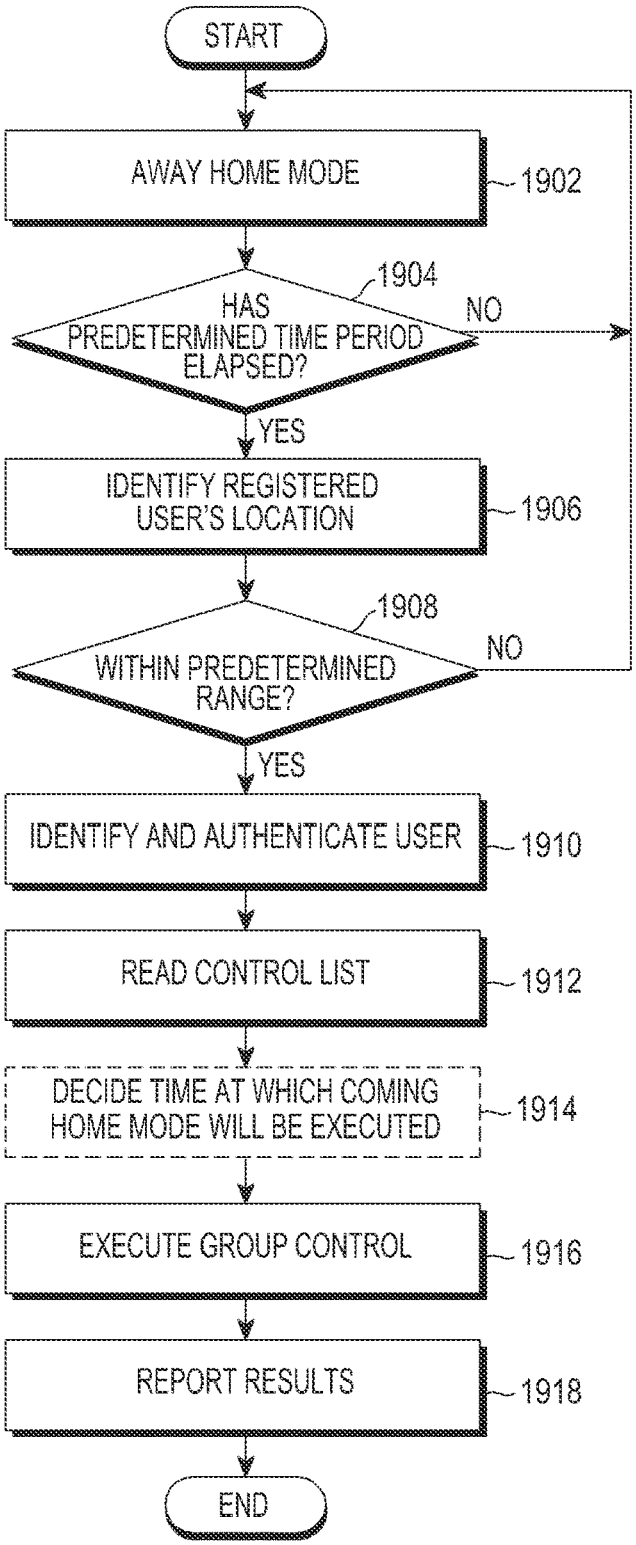
FIG. 19 is a flowchart of an operation in which a home gateway performs a group control according to a location of a mobile station according to an embodiment of the present disclosure.

FIG. 19 is a flowchart of an operation in which a home gateway performs a group control according to a location of a mobile station according to another embodiment of the present disclosure.

Referring to FIG. 19, a home gateway may be set to the away home mode, in operation 1902. Setting to the away home mode may be done manually or remotely by a user, or may be performed according to a request from a mobile station, a RF tag, or a door lock. Then, the home gateway may determine whether a predetermined time period has elapsed, in operation 1904, and if the home gateway determines that the predetermined time period has elapsed, then the home gateway may identify a registered user's location, in operation 1906. However, operation 1904 may be omitted. For example, if triggering is performed according to a request from a user or based on the results of location tracking on a user, then operation 1904 of determining whether a predetermined time period has elapsed is not needed. Identifying the registered user's location may be done by at least one of various well-known techniques, such as receiving a report from the user's mobile station, sending an inquiry to a mobile communication system, and tracking built-in entity installed in the user's mobile station or the user's vehicle using an RFID system, etc. Also, the home gateway may track the locations of one or more of a plurality of registered users.

Thereafter, the home gateway may determine whether at least one registered user is within a predetermined range from a home at which the home gateway is located, in operation 1908, and if the home gateway determines that the registered user is within the predetermined range from the home, then the home gateway may proceed to operation 1910 to identify and authenticate the user. For example, the home gateway may determine whether the user has authority for executing the coming home mode, and if the home gateway determines that the user has authority for executing the coming home mode, then the home gateway proceeds to operation 1912 so as to read a control list for the coming home mode. According to an embodiment, the home gateway may decide a range threshold value depending on an operation of determining a user's location. For example, if a mobile station reports its own relatively accurate location using a GPS module or the like, a relatively small range threshold value may be used. As another example, when RF tags installed at the entrance of an apartment house or at a parking lot are used, then a relatively large range threshold value may be used.

Also, in operation 1908, instead of determining whether a user is within a predetermined range from a home, the home gateway may identify and authenticate the user based on the user's movement path. For example, if the user temporarily enters within the predetermined range and then goes out of the predetermine range on his/her way home, then a determination based on a predetermined range may cause a wrong operation. Accordingly, the user's movement path for going home may be stored in advance so that a control operation can be performed when the user enters within a predetermined range from the home on the user's way home, for example, when the user is located 500*m* from the home. Alternatively, when the user enters within the predetermined range from the home two or three times, a control operation may be performed.

As noted above, the home gateway may read the control list for the coming home mode stored for the user, in operation 1912. According to an embodiment, the home gateway may decide a time at which the coming home mode will be executed, in operation 1914. However, according to an embodiment, operation 1914 may be omitted such that the embodiment of FIG. 19 proceeds from operation 1912 to operation 1916. The home gateway may determine that the coming home mode must be executed after a predetermined time period in consideration of the technique of determining the predetermined range or the user's location. When an RF tag for sensing a mobile station to determine the location of the mobile station is relatively distant from the home, e.g., when the RF tag is located at the entrance of an apartment house, then the home gateway may determine that the coming home mode must be executed after a relatively long time period, e.g., 10 minutes, from when the location of the mobile station has been detected. As another example, when the mobile station reports its own location, as detected by GPS, to the home gateway, then the home gateway may determine that the coming home mode must be executed after a relatively short time period, e.g., 3 to 5 minutes. As still another example, when unlocking of a door lock is sensed, then the home gateway may determine that the coming home mode must be immediately executed.

Thereafter, the home gateway may execute a group control based on the control list, in operation 1916. Then, the home gateway may report the execution results of the group control to the registered mobile station, in operation 1918. The execution results of the group control may include the state, which may be on/off, of each home device, together with guidance words, such as "Coming Home Mode Was Executed by User 2" or "User 2 Came Home".

In an embodiment, a case in which the home gateway senses a user's outing or coming home according to the user's movement, and executes an operation mode according to a type of the movement will be described below. The home gateway may sense the user's movement through built-in entity installed in the user's registered mobile station or vehicle periodically.

Figure 20:
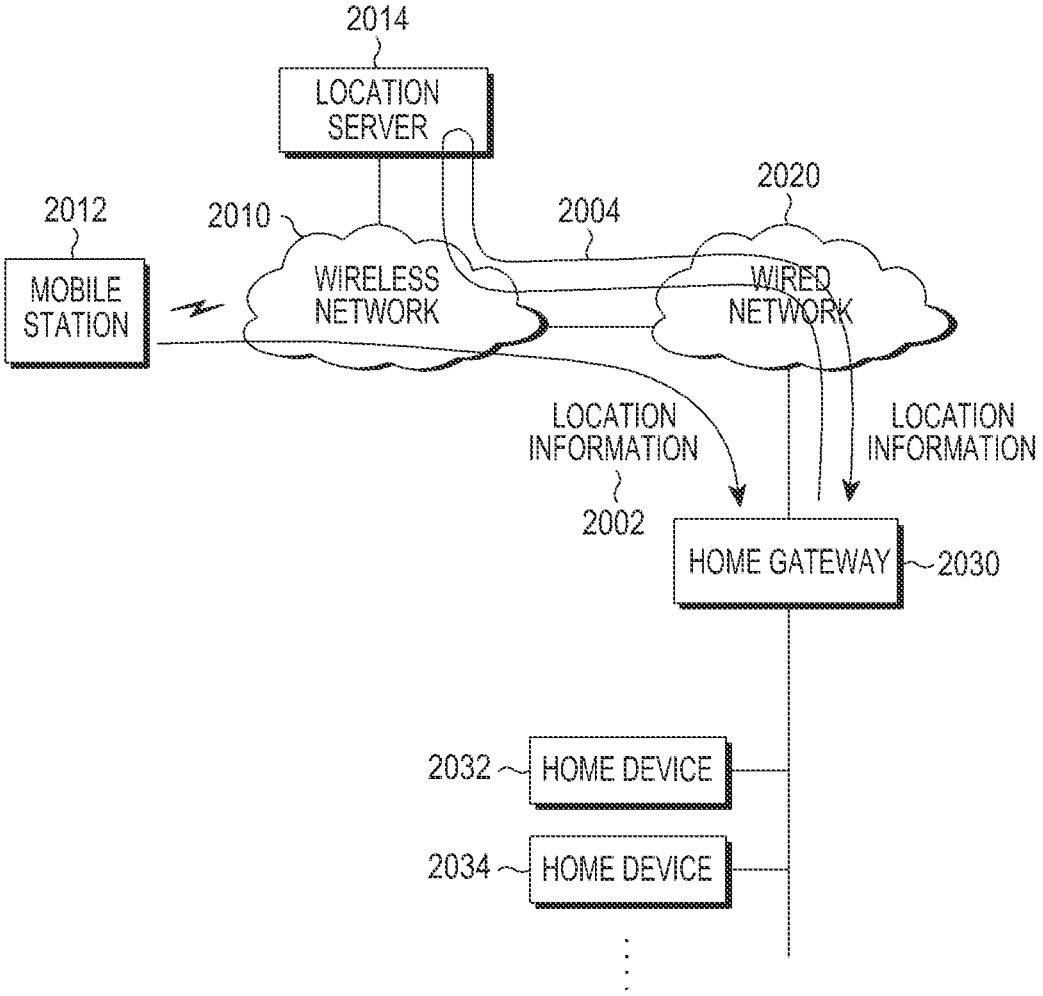
FIG. 20 is a view for describing a procedure in which a home gateway detects a location of a mobile station according to an embodiment of the present disclosure.

FIG. 20 is a view for describing a procedure in which a home gateway detects a location of a mobile station according to an embodiment of the present disclosure.

Referring to FIG. 20, a home gateway 2030 may track the location of a mobile station 2012 periodically. According to an embodiment, the home gateway 2030 may receive a message including location information of the mobile station 2012 from the mobile station 2012 periodically in operation 2002 via a wireless network 2010. The mobile station 2012 may determine its own location using a built-in GPS module, a base station identifier, or another device, and may report location information indicating the determined location to the home gateway 2030 through a wireless network 2010 and a wired network 2020.

According to an embodiment, the home gateway 2030 may inquire of a location server 2014 managing mobility of the mobile station 2012 about location information of the mobile station 2012 periodically, and may receive the location information of the mobile station 2012 from the location server 2014 in operation 2004 via a wired network 2020. The location server 2014 may receive location information of the mobile station 2012 from the mobile station, may track and manage identifiers of base stations to which the mobile station 2012 connects, or may provide the location information of the mobile station 2012 in response to a request from the home gateway 2030.

If the home gateway 2030 determines that the mobile station 2012 has entered within a predetermined range from a home in which a home network system is installed, then the home gateway 2030 may determine that the coming home mode must be executed, and may control home devices 2032 and 2034 according to a control list for the coming home mode. At this time, the home gateway 2030 may execute the coming home mode after a predetermined time period, e.g., 5 to 10 minutes, from when the mobile station 2012 has entered within the predetermined range, in consideration of the movement speed of the mobile station 2012 and the predetermined range. According to an embodiment, when the home gateway 2030 is in the away home mode, then the home gateway 2030 may sense the location of the mobile station 2012 to determine whether to release the away home mode and execute the coming home mode.

When the home gateway 2030 determines that the mobile station 2012 has moved out of the predetermined range from the home in which the home network system is installed, then, based on the location information of the mobile station 2012, the home gateway 2030 may determine that the away home mode must be executed, and may control the home devices 2032 and 2034 according to a control list for the away home mode. In order to exclude a user's temporary outing, the home gateway 2030 may execute the away home mode when the mobile station 2012 does not enter within the predetermined range for a predetermined time period, e.g., 5 to 10 minutes, after moving out of the predetermined range.

In an embodiment, a case in which the location of built-in entity installed in a mobile station or vehicle registered for a user is detected by a plurality of RF tags installed in and near a home will be described below.

Figure 21:
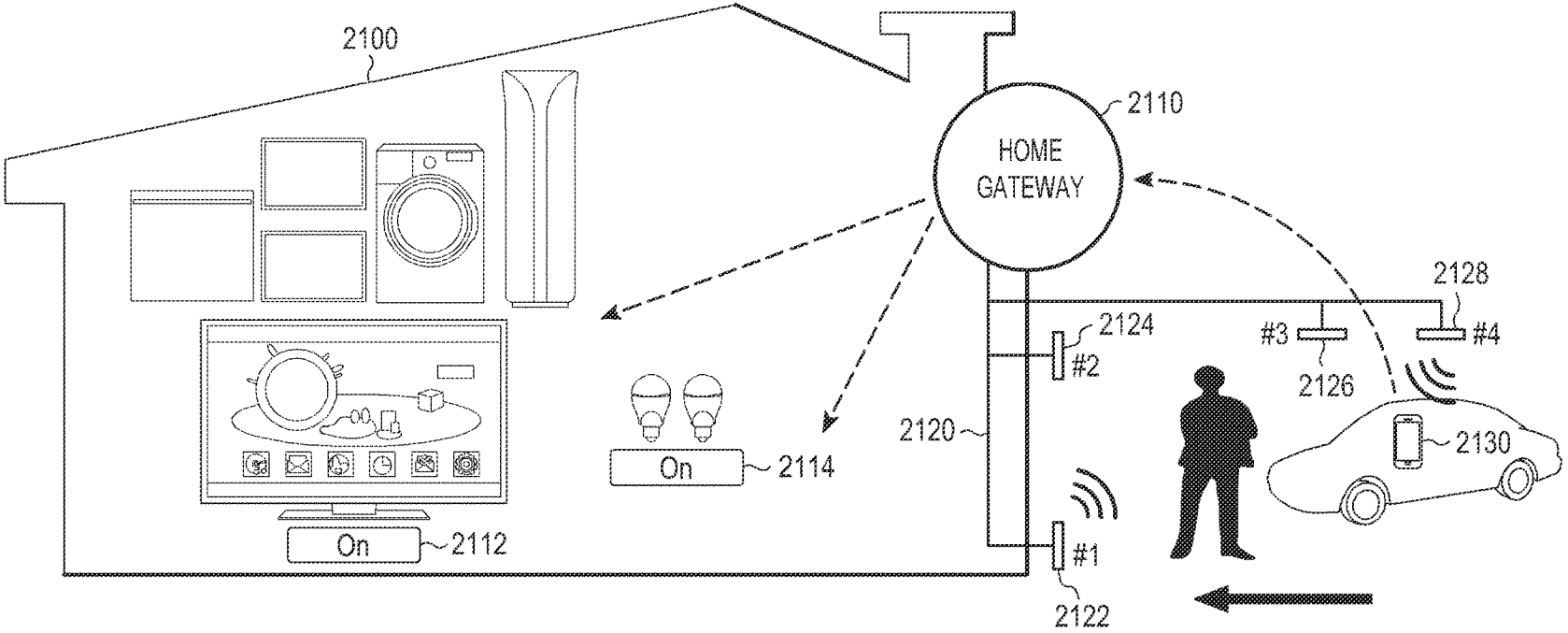
FIG. 21 is a view for describing a procedure of detecting a user's coming home using RF tags according to an embodiment of the present disclosure.

FIG. 21 is a view for describing a procedure of detecting a user's coming home using RF tags according to an embodiment of the present disclosure.

Referring to FIG. 21, an embodiment in which a mobile station 2130 senses first to fourth RF tags 2122 to 2128 and reports its own location to a home gateway 2110, and an embodiment in which the home gateway 2110 receives location information of the mobile station 2130 from the RF tags 2122 to 2128 will be described. A built-in entity, an electronic device including communication capabilities, of a vehicle may operate in the similar manner to the mobile station 2130. The RF tags 2122 to 2128 may be configured such that the mobile station 2130 can detect signals from the RF tags 2122 to 2128 within a predetermined range, e.g., a range of 10 m to 100 m.

According to an embodiment in which the mobile station 2130 senses first to fourth RF tags 2122 to 2128 and reports its own location to a home gateway 2110, the mobile station 2130 may include a tag reader (not shown) to read out unique tag information from the RF tags 2122 and 2128, and may try to sense the RF tags 2122 to 2128 using the tag reader. If the mobile station 2130 senses at least one of the first and second RF tags 2122 and 2124 installed in a home 2100 or at a front door 2120, then the mobile station 2130 may determine that it has approached close to the home 2100, and may request the home gateway 2110 to execute the coming home mode through a network (not shown).

According to an embodiment, if the mobile station 2130 senses at least one of the third and fourth RF tags 2126 and 2128 installed at a location, e.g., the entrance of an apartment house or a parking lot, away from the home 2100, then the mobile station 2130 may store a time at which the RF tag 2126 or 2128 has been sensed, and wait for signals from the first and second RF tags 2122 and 2124. If the first and second RF tags 2122 and 2124 are sensed within a predetermined time period, e.g., 5 minutes, after the third and fourth RF tags 2126 and 2128 have been sensed, then the mobile station 2130 may request the home gateway 2110 to execute the coming home mode.

According to an embodiment, in which the home gateway 2110 receives location information of the mobile station 2130 from the RF tags 2122 to 2128, the RF tags 2122 to 2128 may be configured to perform bidirectional communication, and if the RF tags 2122 to 2128 detect a contact of the mobile station 2130 or existence of the mobile station 2130, then the RF tags 2122 to 2128 may report, to the home gateway 2110, that the mobile station 2130 has been sensed. To do this, the mobile station 2130 may be configured to send unique tag information, and the RF tags 2122 to 2128 may read out the tag information.

More specifically, at least one of the first and second RF tags 2122 and 2124 installed in the home 2100 or at the front door 2120 may read out tag information from the mobile station 2130, and may report the tag information to the home gateway 2110. The home gateway 2110 may determine whether the tag information reported in the away home mode is identical to tag information registered for a user, and if the tag information is identical to the registered tag information, then the home gateway 2110 may instruct home devices 2112 and 2114 to execute the coming home mode with reference to a registered control list. According to an embodiment, when the mobile station 2130 is sensed by the third and fourth RF tags 2126 and 2128 in the away home mode, then the home gateway 2110 may execute the coming home mode after a predetermined time period or immediately.

According to an embodiment, at least one of the third and fourth RF tags 2126 and 2128 may read out tag information from the mobile station 2130, and may report the tag information to the home gateway 2110. The home gateway 2110 may determine whether the tag information is identical to tag information registered for a user, and if the tag information is identical to the registered tag information, then the home gateway 2110 may store a time at which the tag information has been reported, and may then wait for a report from the first and second RF tags 2122 and 2124. If tag information of the mobile station 2130 is reported by at least one of the first and second RF tags 2122 and 2124 within a predetermined time period, e.g., 5 minutes, after the mobile station 2130 has been sensed by the third and fourth RF tags 2126 and 2128, then the home gateway 2110 may instruct the home devices 2112 and 2114 to execute the coming home mode with reference to a registered control list.

Figure 22:
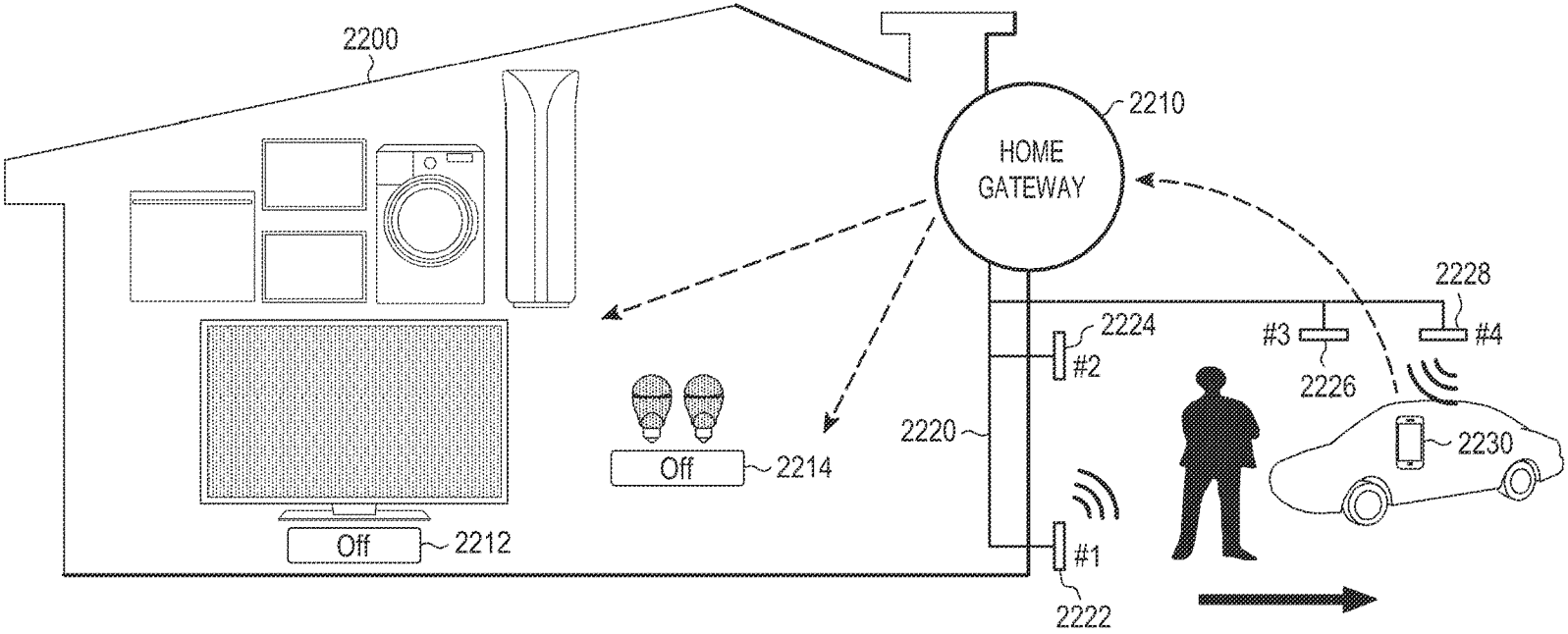
FIG. 22 is a view for describing an operation of detecting a user's outing using RF tags according to an embodiment of the present disclosure.

FIG. 22 is a view for describing a procedure of detecting a user's outing using RF tags according to an embodiment of the present disclosure.

Referring to FIG. 22, a mobile station 2230 may include a tag reader (not shown) to read out unique tag information from first to fourth RF tags 2222 to 2228, and may try to sense the RF tags 2222 to 2228 using the tag reader. If the mobile station 2230 senses at least one of the third and fourth RF tags 2226 and 2228 installed at a location, e.g., an entrance of an apartment house or a parking lot, away from a home 2200 in the coming home mode, then the mobile station 2230 may request a home gateway 2210 to execute the away home mode through a network (not shown). The home gateway 2210 may control home devices 2212 and 2214 to execute the away home mode after a predetermined time period or immediately in response to the request from the mobile station 2230.

According to an embodiment, if the mobile station 2230 senses at least one of the first and second RF tags 2222 and 2224 installed in the home 2200 or at a front door, then the mobile station 2230 may store a time at which the first or second RF tag 2222 or 2224 has been sensed, and may wait for signals from the third and fourth RF tags 2226 and 2228. If the third and fourth RF tags 2226 and 2228 are sensed within a predetermined time period, e.g., 5 minutes, from when the first and second RF tags 2222 and 2224 have been sensed, then the mobile station 2230 may request the home gateway 2210 to execute the away home mode.

According to an embodiment, the first to fourth RF tags 2222 to 2228 may be configured to perform bidirectional communication, and if the first to fourth RF tags 2222 to 2228 detect a contact of the mobile station 2230 or existence of the mobile station 2130, then the RF tags 2222 to 2228 may report that the mobile station 2230 has been sensed to the home gateway 2210. To do this, the mobile station 2230 may be configured to transmit unique tag information, and the RF tags 2222 to 2228 may read out the tag information.

More specifically, at least one of the third and fourth RF tags 2226 and 2228 installed at a location, e.g., the entrance of an apartment house or a parking lot, away from the home 2200 may read out tag information from the mobile station 2230, and may report the tag information to the home gateway 2210. The home gateway 2210 may determine whether the tag information reported in the coming home mode is identical to tag information registered for a user, and if the tag information is identical to the registered tag information, then the home gateway 2210 may instruct the home devices 2212 and 2214 to execute the away home mode with reference to a registered control list. According to an embodiment, when the mobile station 2230 is sensed by the first and second RF tags 2222 and 2224 in the away home mode, then the home gateway 2210 may execute the away home mode after a predetermined time period or immediately.

According to an embodiment, at least one of the first and second RF tags 2222 and 2224 may read out tag information from the mobile station 2230, and may report the tag information to the home gateway 2210. The home gateway 2210 may determine whether the tag information is identical to tag information registered for a user, and if the tag information is identical to the registered tag information, then the home gateway 2210 may store a time at which the tag information has been reported, and then the home gateway 2210 may wait for a report from the third and fourth RF tags 2226 and 2228. If tag information of the mobile station 230 is reported from at least one of the third and fourth RF tags 2226 and 2228 within a predetermined time period, e.g., 5 minutes, from when the mobile station 2230 has been sensed by the first and second RF tags 2222 and 2224, then the home gateway 2210 may instruct home devices 2212 and 2214 to execute the away home mode with reference to a registered control list.

In an embodiment, a case in which a mobile station requests a home gateway to execute a group control for a specific operation mode according to an input from the user will be described below.

Figure 23:
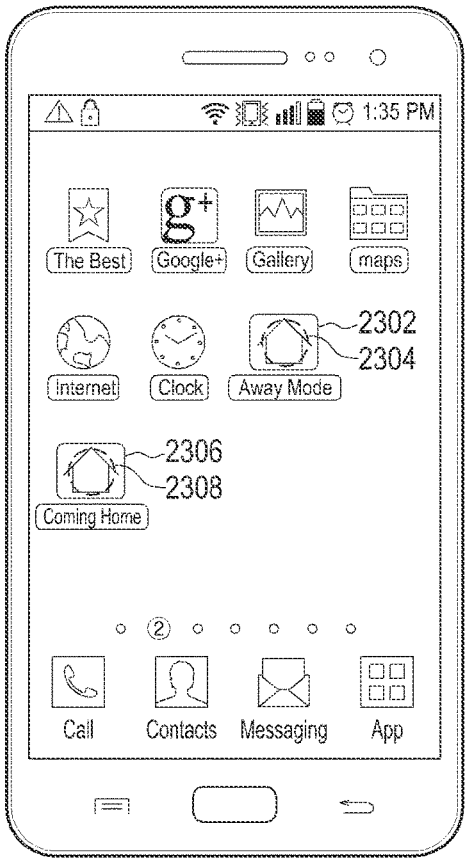
FIG. 23 illustrates a user interface of a mobile station for requesting execution of a group control according to an embodiment of the present disclosure.

FIG. 23 illustrates a user interface of a mobile station for requesting execution of a group control according to an embodiment of the present disclosure.

Referring to FIG. 23, a mobile station may provide application/widget icons 2302 and 2306 for executing operation modes for a group control of home devices registered in a home network system. For example, the icon 2302 connects to a widget for executing the away home mode, and the icon 2306 connects to a widget for executing the coming home mode. If a user's gesture 2304, e.g., a touch operation, is sensed on the icon 2302, then the mobile station may transmit a request message for executing the away home mode to a home gateway through the Internet. If a user's gesture 2308, e.g., a touch operation, is sensed on the icon 2306, then the mobile station may transmit a request message for executing the coming home mode to the home gateway through the Internet.

According to another embodiment, the mobile station may provide an icon for allowing a user to input a voice command, and if a user's gesture is sensed on the icon, and a voice command, e.g., "Execute Away home Mode" or "Execute Coming home mode", is input, then the mobile station may transmit a request message for executing the corresponding mode to the home gateway.

Figure 24:
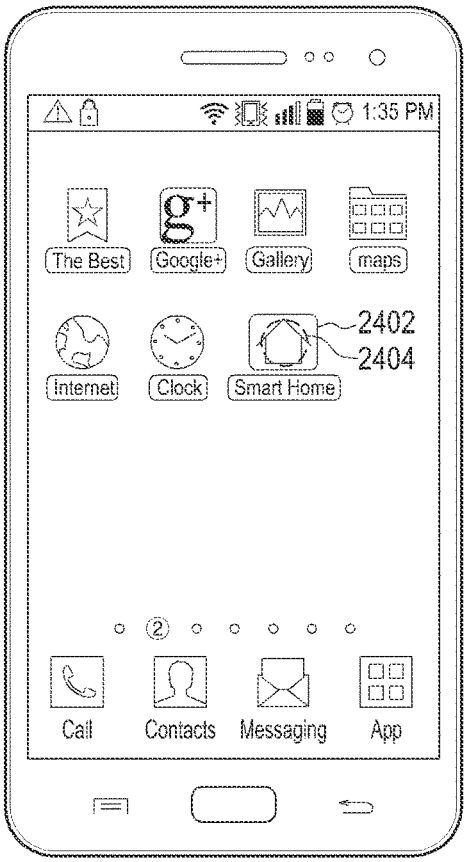
FIG. 24 illustrates a user interface of a mobile station for executing a remote control application according to an embodiment of the present disclosure.

FIG. 24 illustrates a user interface of a mobile station for executing a remote control application according to an embodiment of the present disclosure.

Referring to FIG. 24, a mobile station may provide an application/widget icon 2402 for executing an installed remote control application, and if a user's gesture 2404, e.g., a touch operation, is sensed on the icon 2402, then the mobile station may execute the remote control application.

Figure 25:
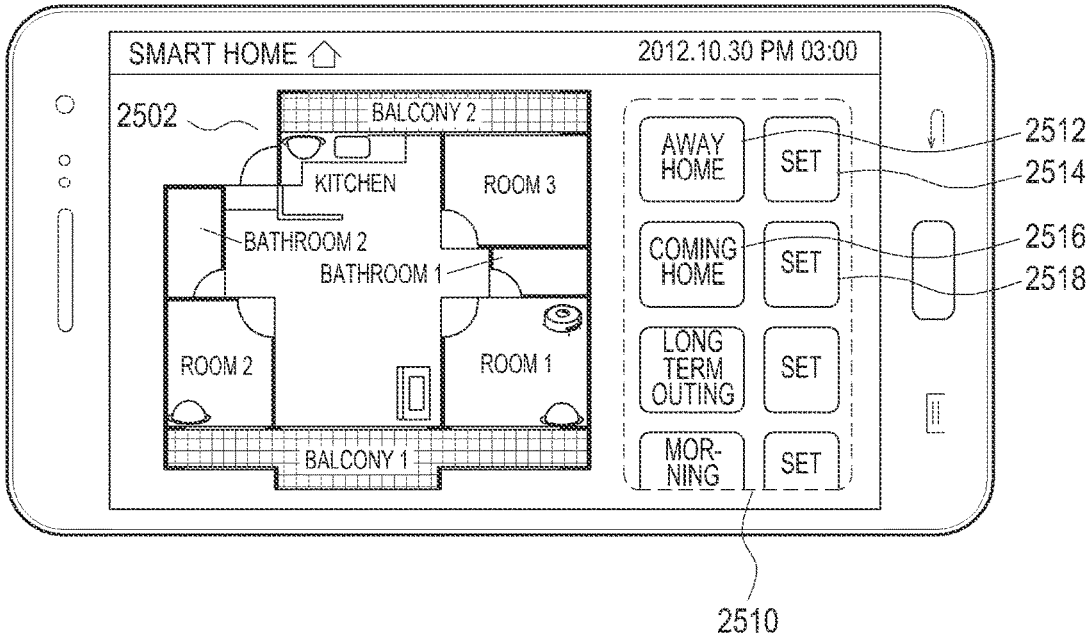
FIG. 25 illustrates a screen configuration for a group control of a remote control application according to an embodiment of the present disclosure.

FIG. 25 illustrates a screen configuration for a group control of a remote control application according to an embodiment of the present disclosure.

Referring to FIG. 25, if a remote control application is executed by a user, then the remote control application may provide predetermined screen configurations 2502 and 2510, wherein the screen configuration 2502 may be referred to as a layout 2502 and the screen configuration 2510 may be referred to as a control area 2510. For example, the remote control application may display the layout 2502 of a home in which a home network system is installed. The layout 2502 may display regions sectioned in the home, for example, rooms, a living room, balconies, a front door, etc., and may include symbols (not shown) indicating controllable home devices in the individual regions. According to another embodiment, the remote control application may play video being recorded by one of cameras registered in the home network system on a screen of a mobile station, which is not shown.

The remote control application may provide the control area 2510 to receive an input for executing at least one operation mode for the group control. The control area 2510 may provide a soft key 2512 for executing the away home mode and a soft key 2516 for executing the coming home mode. In addition, the control area 2510 may provide a soft key 2514 for setting and/or checking the away home mode, and a soft key 2518 for setting and/or checking the coming home mode. The soft keys 2514 and 2518 for settings may be provided through a different control area from the soft keys 2512 and 2516 for executing operation modes.

If a user's gesture is sensed on the soft key 2512 for executing the away home mode, then the mobile station may transmit a request message for executing the away home mode to the home gateway through the Internet. If a user's gesture is sensed on the soft key 2516 for executing the coming home mode, then the mobile station may transmit a request message for executing the coming home mode to the home gateway through the Internet.

If a user's gesture is sensed on the soft key 2514 for setting the away home mode, then the mobile station may display a menu, which may also be referred to as a control list menu, for editing a control list of the away home mode on a screen. Likewise, if a user's gesture is sensed on the soft key 2518 for setting the coming home mode, then the mobile station may display a menu for editing a control list of the coming home mode on a screen.

According to an embodiment, each control list menu may include a device list on which home devices controllable by the home gateway are arranged, and a function list on which controllable functions of the individual home devices included in the device lists are arranged. According to an embodiment, the control list menu may include a region list on which sectioned regions, e.g., rooms, a living room, a kitchen, balconies, and a front door, of the home in which the home network system is installed are arranged, a device list for each region, and a function list for each device.

FIG. 26 illustrates a graphics-type control list menu according to an embodiment of the present disclosure. The control list menu shown in FIG. 26 may be displayed on a screen of a mobile station in response to a request for setting or checking a control list for a specific operation mode.

Referring to FIG. 26, the mobile station may display a control list menu configured with a plurality of menu areas 2610, 2620, 2630, and 2640 corresponding to a plurality of regions in a home, for example and respectively, a kid's room, a bedroom, a living room, and a kitchen, in response to a request for setting or checking a control list for a specific operation mode. In FIG. 26, the control list menu includes the four menu areas 2610 to 2640, however, the control list menu may further include additional menu areas. A user may input a drag gesture on the screen on which the control list menu is displayed so as to display the remaining menu areas. For example, the control list menu may further include a menu area corresponding to lighting devices, a menu area corresponding to security devices, and a menu area corresponding to energy devices.

At least one of the menu areas 2610 to 2640 may include symbols of home devices located in the corresponding region. For example, the menu area 2620, corresponding to the bedroom, may include a TV symbol 2622, a curtains symbol 2624, and a humidifier symbol (not shown), the menu area 2630 corresponding to the living room may include an audio symbol, a curtains symbol, and an air conditioner symbol, and the menu area 2640 corresponding to the kitchen may include a toaster symbol, an oven symbol, and a coffee machine symbol. Each symbol may further include a state indicator, such as text or a small image, representing a current state of the corresponding home device. For example, the TV symbol 2622 may include a text indicator 2622*a* representing "CNN News (CH9)", and the curtains symbol 2624 may include a text indicator 2624*a* representing "Fully opened". Likewise, the audio symbol may include a text indicator representing "Air on the G string", the toaster symbol may include a text indicator representing "Defrost crispy", and the oven symbol may include a text indicator representing "Morning roll".

If a user's gesture for editing functions used for a current operation mode is sensed on a symbol, e.g., the TV symbol 2622 in the bedroom menu area 2620, corresponding to a desired home device, then the mobile station may provide menus of functions, e.g., an on/off selection menu, a channel change menu, and a volume adjustment menu, that can be provided through a TV, and may receive a selection of at least one function that is to be executed in the current operation mode from among the function menus from the user. For example, in order to set the coming home mode, the mobile station may receive information "ON, CH9, volume 5, Greeting ON" for a TV, and may provide the received information to the home gateway such that the received information is stored as a control list for the coming home mode. According to an embodiment, the mobile station may create a control list for the coming home mode according to received information, and may transmit the control list to the home gateway.

As another example, if a user's gesture is sensed on the curtains symbol in the living room menu area 2630, then the mobile station may provide menus, e.g., an on/off selection menu and a degree-of-open adjustment menu, of functions that can be provided for curtains at the living room, and may receive a selection of at least one function, e.g., "ON, Fully opened", that is to be executed in the current operation mode from among the provided menus, from the user.

Figure 27:
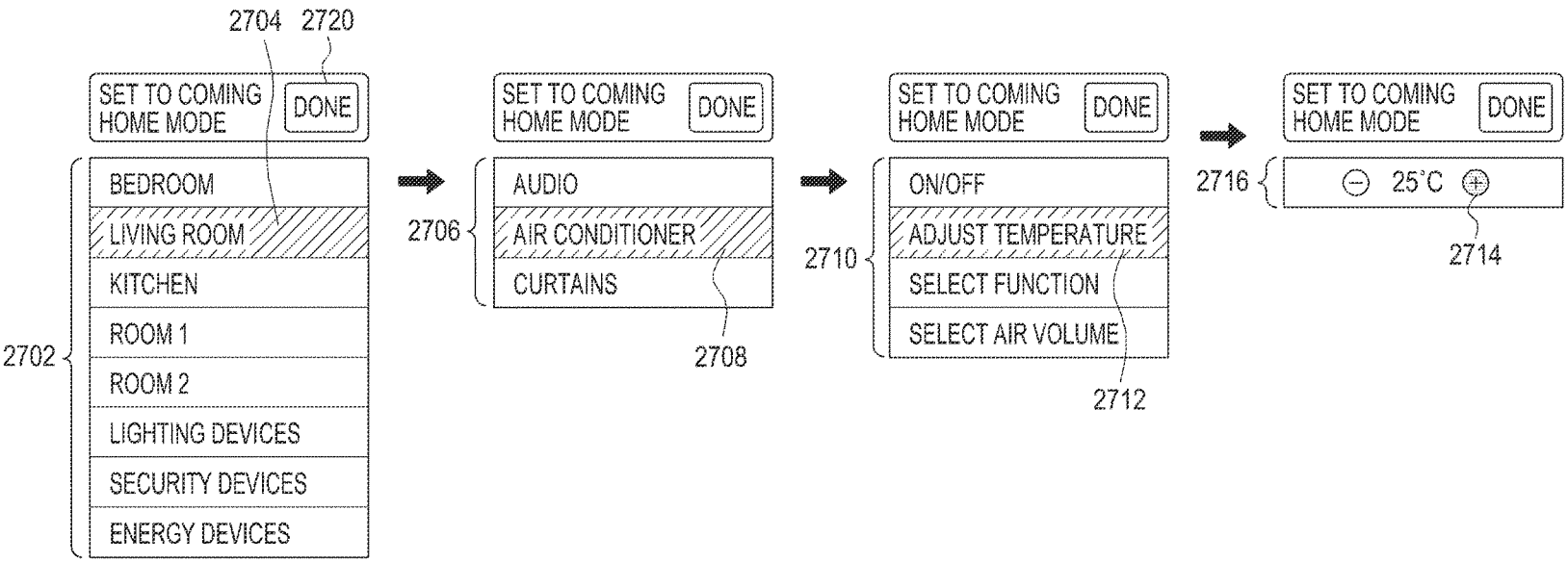
FIG. 27 illustrates list-type control list menus according to an embodiment of the present disclosure.

FIG. 27 illustrates list-type control list menus according to an embodiment of the present disclosure. The control list menus may be displayed in order on a screen of a mobile station in response to a request for setting and/or checking a control list for a specific operation mode.

Referring to FIG. 27, the mobile station may display a first stage control list menu 2702 configured with menu items corresponding to a plurality of categories, that is, a bedroom, a living room, a kitchen, a room 1, a room 2, lighting devices, security devices, and energy devices, in response to a request for setting or checking a control list for a specific operation mode. If a user's gesture is sensed on a living room item 2704 in the first stage control list menu 2702, then the mobile station may display a second stage control list menu 2706 configured with menu items corresponding to home devices, e.g., an audio, an air conditioner, and curtains, located in the living room. Thereafter, if a user's gesture is sensed on an air conditioner item 2708 in the second stage control list menu 2706, then the mobile station may display a third stage control list menu 2710 configured with menu items corresponding to functions, e.g., on/off, adjust temperature, select function, and select air volume, that can be provided through the air conditioner. If a user's gesture is sensed on a temperature adjustment item 2712 in the third stage control list menu 2710, then the mobile station may display a fourth stage control list menu 2716 including +/− keys 2714 for adjusting a temperature. If a desired temperature is set through the +/− keys 2714, the mobile station may store the desired temperature.

Likewise, the mobile station may receive selections of other functions of the air conditioner through the fourth stage control list menu 2710, and may receive selections of functions of other home devices through the first and second stage control list menus 2702 and 2706. Although not shown in the drawings, the mobile station may further provide additional stage control list menus for receiving selections of desired functions of home devices that can be controlled in a home network system. Also, each item included in each stage control list menu may include a small image and/or text describing the item.

According to an embodiment, the mobile station may provide a Done button 2720 for completing a function setting. If a user selects the Done button 2720 after setting all desired functions for a specific operation mode, a control list created according to input information may be transmitted to a home gateway.

Figure 28:
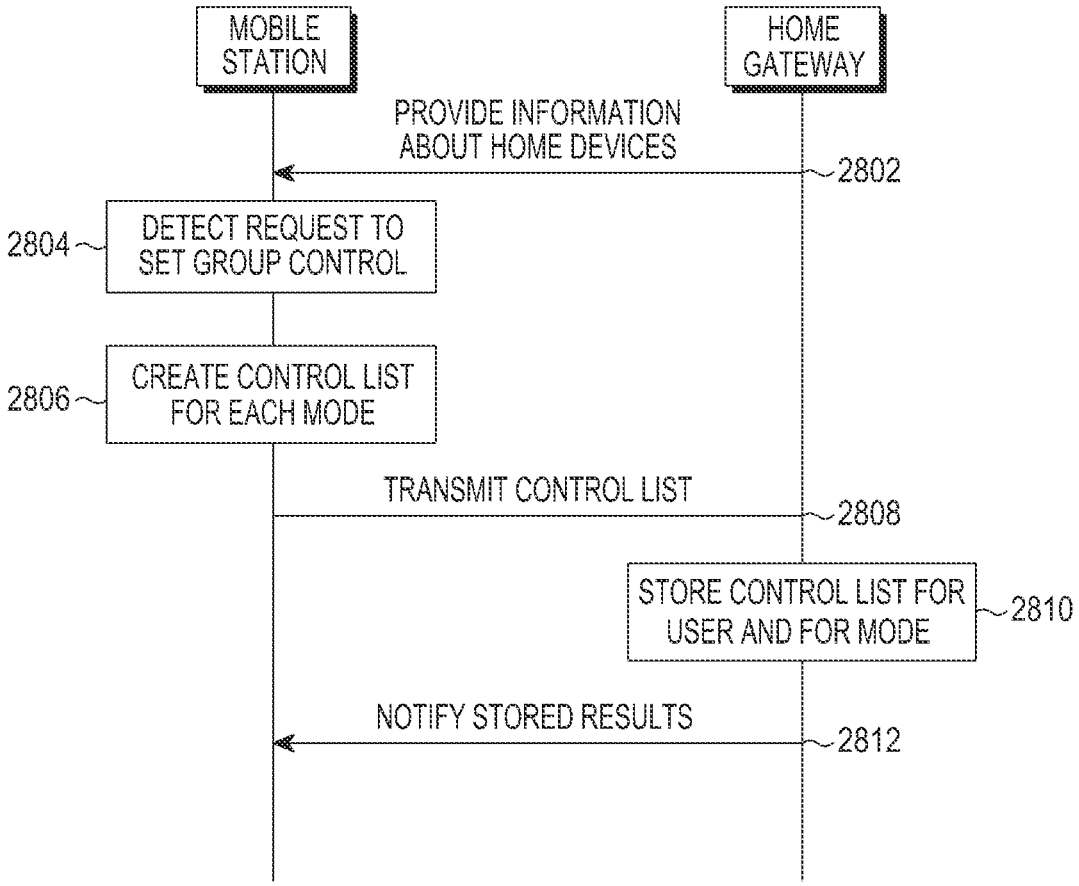
FIG. 28 is a flowchart of a procedure of creating a control list according to an operation mode according to an embodiment of the present disclosure.

FIG. 28 is a flowchart of a procedure of creating a control list for an operation mode according to an embodiment of the present disclosure.

Referring to FIG. 28, a home gateway may provide a mobile station with information about home devices that are included in a home network system and that are controllable through the mobile station, in operation 2802. The information about the home devices may include at least one of identifiers, performance information, and state information of the home devices. For example, information about home devices may be provided to the mobile station whenever each home device is installed and registered. As another example, information about home devices may be provided to the mobile station when the mobile station is installed and registered, periodically, and/or according to a request from the mobile station.

Thereafter, the mobile station may detect a request for setting a group control for a specific operation mode from a user, in operation 2804. Then, the mobile station may create a control list for each mode in operation 2806, and the mobile station may, in operation 2806, create control list creation information, including identification information of home devices that are to be controlled and information about functions of the home devices, based on information input by the user for the operation mode. Herein, the control list creation information is information needed for a home gateway to create a control list.

The mobile station may transmit the created control list from to the home gateway, in operation 2808, and the home gateway may store the control list for each user and for each operation mode, in operation 2810. To do this, the mobile station may provide an identifier of the mobile station and an indicator indicating a desired operation mode to the home gateway, together with the control list. The home gateway may determine whether a user of the mobile station has authority for a group control based on the identifier of the mobile station, and if the user of the mobile station has authority for the group control, then the home gateway may store the control list in association with an operation mode corresponding to the indicator. If the control list creation information is provided by the mobile station, then the home gateway may create a control list for each user and for each operation mode based on the control list creation information, and may store the control list.

Thereafter, the home gateway may notify the mobile station that the control list has been successfully stored, or in other words, notify stored results, in operation 2812. If the mobile station has no authority for the group control or if the control list cannot be stored, then the home gateway may notify the mobile station that setting a control list has failed.

In an embodiment described below, a morning mode, which is another operation mode for providing a group control, will be described. The morning mode provides a group control of home devices in association with a morning alarm function of a mobile station.

Figure 29:
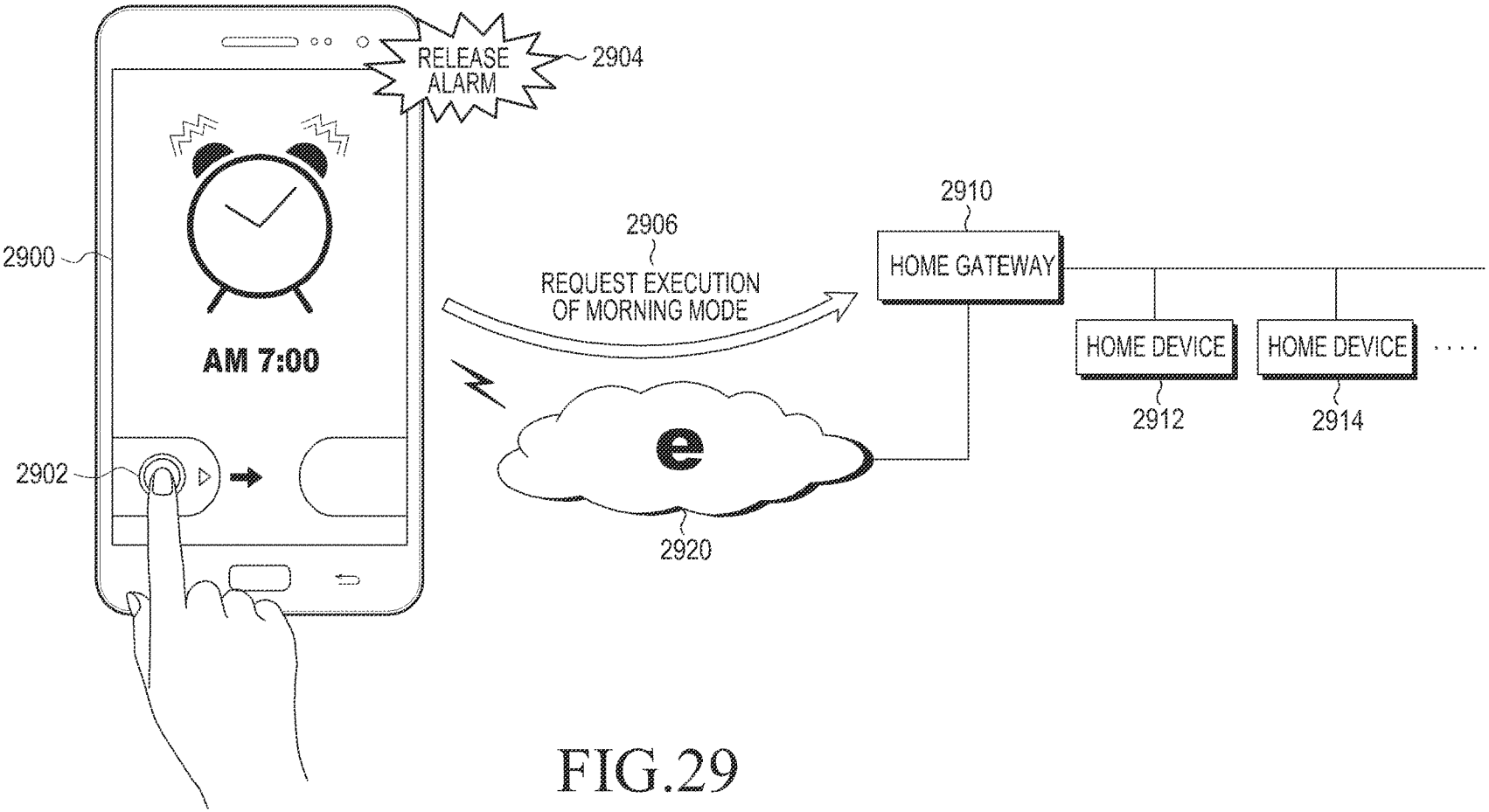
FIG. 29 is a view for describing an operation of entering and executing a morning mode according to an embodiment of the present disclosure.

FIG. 29 is a view for describing an operation of entering and executing a morning mode according to an embodiment of the present disclosure.

Referring to FIG. 29, a mobile station 2900 may display an alarm screen and ring an alarm, such as a bell sound or a vibration, at a scheduled time of a morning mode set by a user. If a user's gesture for releasing the alarm is sensed on the alarm screen in operation 2902, for example, if a slide operation is sensed on a release button, the mobile station 2900 may release the alarm in operation 2904, and may simultaneously transmit a request message for executing the morning mode to a home gateway 2910 through a network 2920 in operation 2906. The home gateway 2910 may control home devices 2912 and 2914 according to a control list set for the morning mode in response to the request message from the mobile station 2900.

Figure 30:
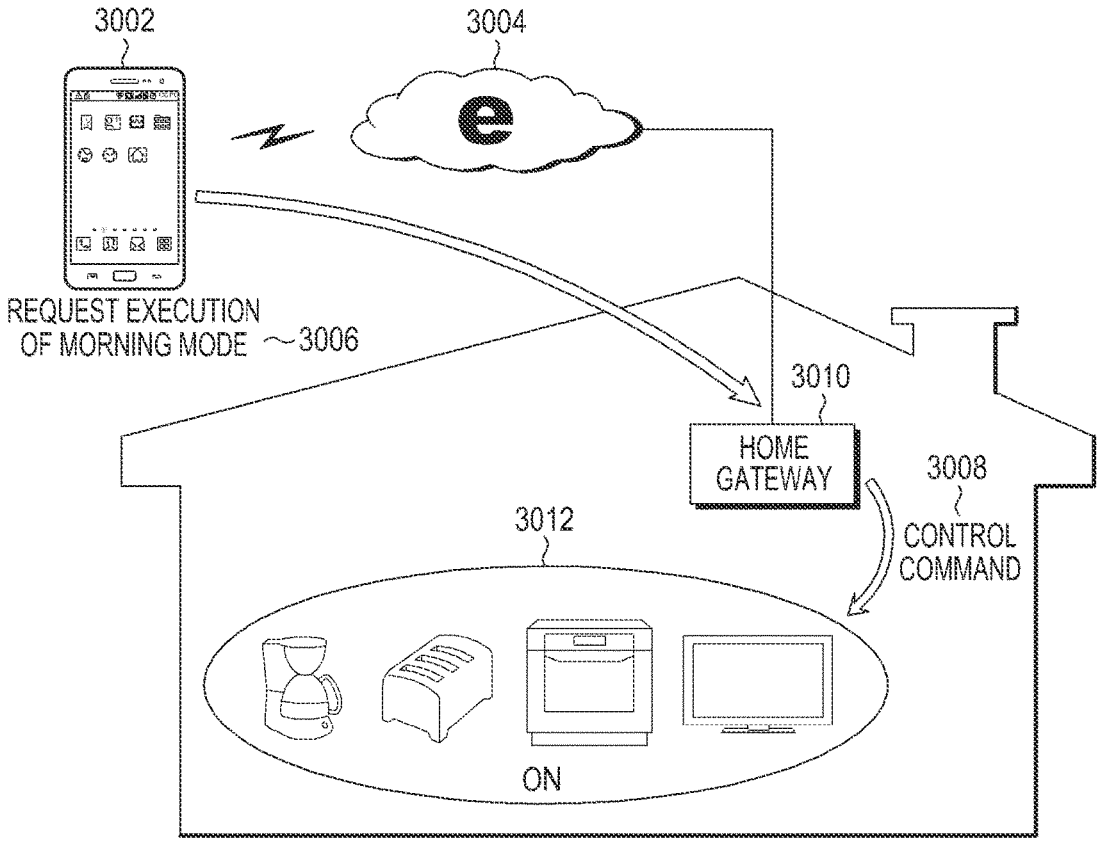
FIG. 30 is a view for describing a group control of home devices for a morning mode according to an embodiment of the present disclosure.

FIG. 30 is a view for describing a group control of home devices in a morning mode according to an embodiment of the present disclosure.

Referring to FIG. 30, if a mobile station 3002 transmits a request message for executing a morning mode to a home gateway 3010 through the Internet 3004 in operation 3006, then the home gateway 3010 may search for and read a control list stored for the morning mode. For example, the control list of the morning mode may include turning on a coffee machine, preheating a toaster, turning on a TV, and a channel number. The following Table 4 shows an example of the control list for the morning mode.

TABLE 4

| Morning Mode | | | |
|---|---|---|---|
| Region | Home Device | Operation | Additional Function |
| Bedroom | TV | ON | CNN News (CH9), Greeting ON |
| | Curtains | ON | Fully Opened |
| Living Room | Audio | ON | CD Player |
| | Curtains | ON | Fully Opened |
| Kitchen | Toaster | ON | Defrost crispy |
| | Coffee Machine | ON | 2 Shots Espresso |
| Lighting devices | Bedroom 1 | ON | Dim up |
| | Living Room 1 | ON | Dim up |
| | Kitchen 1 | ON | Dim up |

The home gateway 3010 may transmit control commands 3008 for instructing home devices 3012, e.g., a coffee machine, a toaster, and a TV, included in the control list to execute designated functions, to the home devices 3012. According to an embodiment, the home gateway 3010 may report the execution results of the morning mode to the mobile station 3002.

Figure 31:
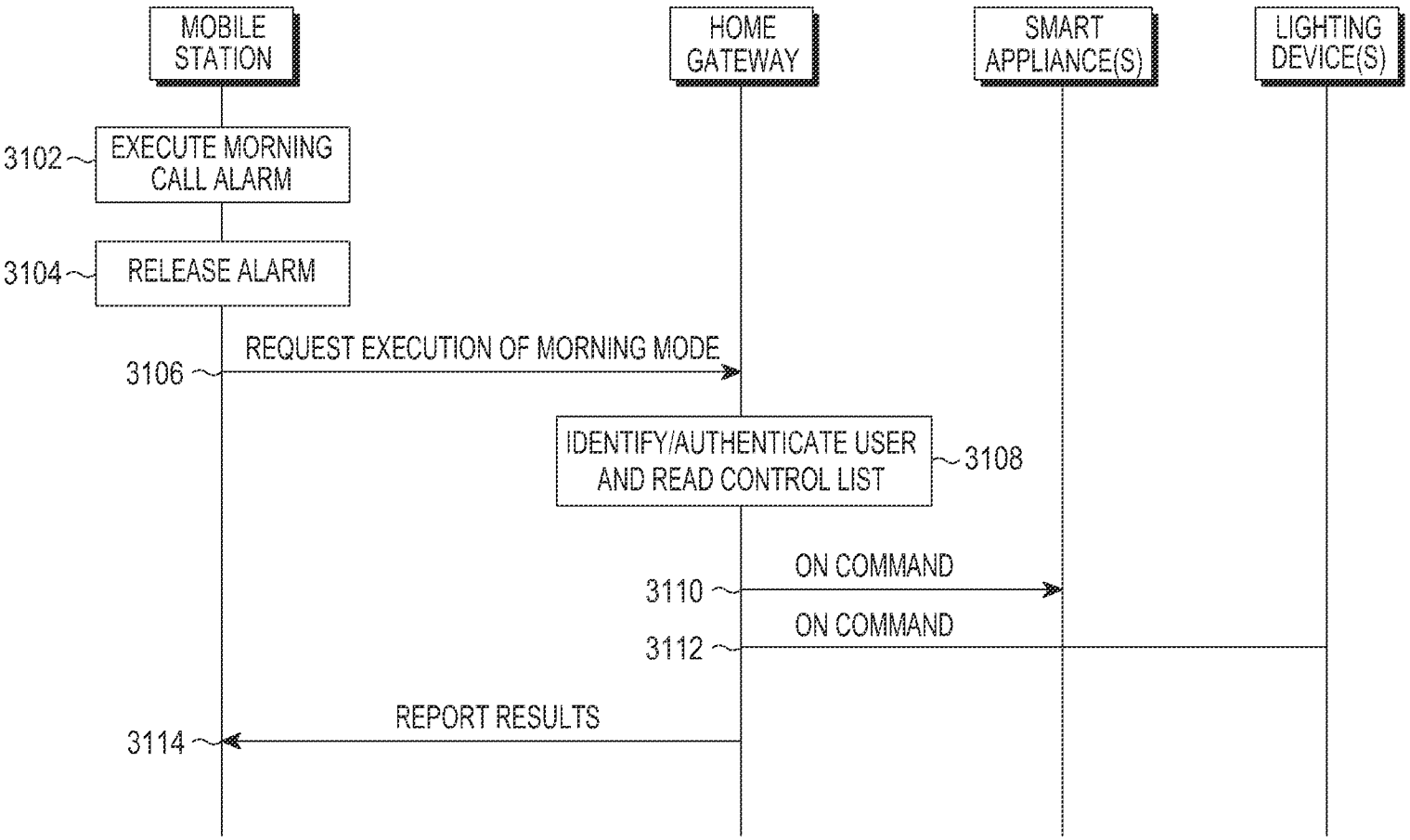
FIG. 31 is a flowchart of an operation of executing a morning mode according to an embodiment of the present disclosure.

FIG. 31 is a flowchart of an operation of executing the morning mode according to an embodiment of the present disclosure.

Referring to FIG. 31, a mobile station may execute a morning call alarm at a scheduled time, in operation 3102. Thereafter, the mobile station releases the alarm in operation 3104, and the mobile station may transmit a request message for executing the morning mode to a home gateway through the Internet, in operation 3106. The request message may include an identifier of the mobile station and an indicator indicating the morning mode.

Then, the home gateway may identify and authenticate the mobile station in response to the request message, and read a control list for the morning mode stored for a user of the identified mobile station, in operation 3108. If the mobile station has been registered in the home gateway and has authority for executing the morning mode, then the home gateway may search for a control list for the morning mode stored for the mobile station. If no control list stored for the mobile station is found, then the home gateway may operate according to a default control list or may report the execution failure of the morning mode to the mobile station, according to a predetermined operation. In contrast, if a control list stored for the mobile station is found, then the home gateway may control the home devices included in the control list to execute designated functions, in operations 3110 and 3112.

According to an embodiment, the home gateway may report results of the execution of the morning mode to the mobile station, in operation 3114.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method in which a home gateway controls home devices in a home network system, the method comprising:

receiving, from a first mobile device, a request signal for changing to a first operation mode from a second operation mode if a state change related to a door in the home network system is detected while in the second operation mode based on detection of at least one radio frequency (RF) tag installed on or around the door by the first mobile device, wherein each of the first and second operation modes is associated with at least one home device and one or more functions to be executed by the at least one home device;

determining the at least one home device associated with the first operation mode from among home devices in the home network system;

transmitting at least one control command to the at least one home device to execute the one or more functions based on the first operation mode; and reporting, to a second mobile device, an execution result of the one or more functions associated with the first operation mode and information on the first mobile device, wherein the request signal further comprises information indicating the one or more functions to be executed by the at least one home device associated with the first operation mode, and wherein if the first operation mode is a coming home mode, the one or more functions associated with the coming home mode comprises at least one of:

turning on at least one of: a television (TV) set to a designated channel, an audio device, an air conditioner set to a designated temperature, or designated lighting devices, opening at least one curtains in at least one designated room, turning off security devices, or outputting a welcome message through an output device.

2. The method of claim 1, wherein the first operation mode is triggered based on at least one of: tag information associated with the at least one of the RF tags, location information of the first mobile device, or a user input on the first mobile device.

3. The method of claim 1, wherein the first mobile device comprises a radio frequency identification (RFID) reader and detects, by the RFID reader, a signal from a RF tag associated with the first operation mode and installed on or around the door.

4. The method of claim 3, wherein the first mobile device is configured to transmit the request signal in response to one of:

detecting tag information of a first RF tag associated with the first operation mode of the at least one RF tag, a location of the first mobile device, and a user input requesting the first operation mode.

5. The method of claim 1, wherein each of the at least one control command comprises information indicating the one or more functions to be executed by the at least one home device in the first operation mode.

6. The method of claim 1, further comprising: determining that a morning mode is triggered by detecting that a morning call alarm is released.

7. The method of claim 1, wherein the first operation mode is an away home mode, and wherein the one or more functions associated with the away home mode comprises at least one of:

turning off at least one of: a television (TV), an air conditioner, a gas valve, or lighting devices, closing curtains, and turning on at least one of: a door lighting device, a security device, or a door lock.

8. A method performed by a first mobile device in a home network system comprising home devices, the method comprising:

determining that an operation mode is changed to a first operation mode if a state change related a door in the home network system is detected while in a second operation mode based on detection of at least one radio frequency (RF) tag installed on or around the door by the first mobile device, wherein each of the first operation mode and the second operation mode is associated with at least one home device and one or more functions to be executed by the at least one home device; and transmitting a request signal for executing the first operation mode to a home gateway of the home network system, wherein a report on an execution result of the one or more functions associated with the first operation mode is transmitted from the home gateway to a second mobile device with information on the first mobile device, wherein the request signal further comprises information indicating the one or more functions to be executed by the at least one home device associated with the first operation mode, and wherein if the first operation mode is a coming home mode, the one or more functions associated with the coming home mode comprises at least one of:

turning on at least one of: a television (TV) set to a designated channel, an audio device, an air conditioner set to a designated temperature, or designated lighting devices, opening at least one curtains in at least one designated room, turning off security devices, or outputting a welcome message through an output device.

9. The method of claim 8, wherein the determining comprises:

detecting a signal from a RF tag associated with the first operation mode and installed on or around the door by using a radio frequency identification (RFID) reader included in the first mobile device.

10. The method of claim 8, wherein the first operation mode is triggered based on one of:

detecting tag information of a first RF tag associated with the first operation mode among the at least one RF tag, a location of the first mobile device, and a user input requesting the first operation mode.

11. The method of claim 8, wherein the request signal comprises information indicating the at least one home device associated with the first operation mode.

12. The method of claim 8, wherein the request signal comprises information indicating the one or more functions to be executed by the at least one home device associated with the first operation mode.

13. The method of claim 12, wherein the first operation mode is an away home mode, and wherein the one or more functions associated with the away home mode comprises at least one of:

turning off at least one of: a television (TV), an air conditioner, a gas valve, or lighting devices, closing curtains, and turning on at least one of: a door lighting device, a security device, or a door lock.

14. An apparatus in a home gateway for controlling home devices in a home network system, the apparatus comprising:

a communication interface configured to transmit at least one control command to at least one home device and receive a request signal for executing a first operation mode from a first mobile device, if a state change related to a door in the home network system is detected while in a second operation mode based on detection of at least one radio frequency (RF) tag installed on or around the door by the first mobile device, wherein each of the first and second operation modes is associated with at least one home device and one or more functions to be executed by the at least one home device; and at least one processor configured to:

in response to receiving the request signal, change to the first operation mode from the second operation mode, determine the at least one home device associated with the first operation mode from among home devices in the home network system, generate the at least one control command for the at least one home device to execute the one or more functions associated with the first operation mode, and report, to a second mobile device, an execution result of the one or more functions associated with the first operation mode and information on the first mobile device, wherein the request signal further comprises information indicating the one or more functions to be executed by the at least one home device associated with the first operation mode, and wherein, if the first operation mode is a coming home mode, the one or more functions associated with the coming home mode comprises at least one of:

turning on at least one of: a television (TV) set to a designated channel, an audio device, an air conditioner set to a designated temperature, or designated lighting devices, opening at least one curtains in at least one designated room, turning off security devices, or outputting a welcome message through an output device.

15. The apparatus of claim 14, wherein the first operation mode is triggered based on at least one of: tag information associated with the at least one of the at least one RF tag, location information of the first mobile device, a request signal from a mobile device comprising a radio frequency identification (RFID) reader, or a user input on the first mobile device.

16. The apparatus of claim 14, wherein the communication interface is further configured to:

receive the request signal from the first mobile device, wherein the first mobile device comprises a radio frequency identification (RFID) reader that detects a signal from a RF tag associated with the first operation mode and installed on or around the door.

17. The apparatus of claim 16, wherein the first mobile device is configured to transmit the request message in response to one of:

detecting tag information of a first RF tag associated with the first operation mode of the at least one RF tag, a location of the first mobile device, and a user input requesting the first operation mode.

18. The apparatus of claim 14, wherein each of the at least one control command comprises information indicating the one or more functions to be executed by the at least one home device in the first operation mode.

19. The apparatus of claim 14, wherein the at least one processor is further configured to determine that a morning mode is triggered by detecting that a morning call alarm is released.

20. The apparatus of claim 14, wherein the first operation mode is an away home mode, and wherein the one or more functions associated with the away home mode comprises at least one of:

turning off at least one of: a television (TV), an air conditioner, a gas valve, or lighting devices, closing curtains, and turning on at least one of: a door lighting device, a security device, or a door lock.

21. An apparatus in a first mobile device associated with a home network system comprising home devices, the apparatus comprising:

at least one processor configured to determine that an operation mode is changed to a first operation mode if a state change related a door in the home network system is detected while in a second operation mode based on detection of at least one radio frequency (RF) tag installed on or around the door by the first mobile device, wherein each of the first and second operation modes is associated with at least one home device and one or more functions to be executed by the at least one home device, and the RF tags include a first RF tag associated with the first operation mode and a second RF tag associated with the second operation mode; and a communication interface configured to transmit a request signal for executing the first operation mode to a home gateway of the home network system, wherein a report on an execution result of the one or more functions associated with the first operation mode is transmitted from the home gateway to a second mobile device with information on the first mobile device, wherein the request signal further comprises information indicating the one or more functions to be executed by the at least one home device associated with the first operation mode, and wherein if the first operation mode is a coming home mode, the one or more functions associated with the coming home mode comprises at least one of:

turning on at least one of: a television (TV) set to a designated channel, an audio device, an air conditioner set to a designated temperature, or designated lighting devices, opening at least one curtains in at least one designated room, turning off security devices, or outputting a welcome message through an output device.

22. The apparatus of claim 21, wherein the at least one processor is further configured to detect a signal from the first RF tag associated with the first operation mode and installed on or around the door by using a radio frequency identification (RFID) reader included in the first mobile device.

23. The apparatus of claim 21, wherein the first operation mode is triggered based on one of:

detecting tag information of the first RF tag associated with the first operation mode among the at least one RF tag, a location of the first mobile device, and a user input requesting the first operation mode.

24. The apparatus of claim 21, wherein the request signal comprises information indicating the at least one home device associated with the first operation mode.

25. The apparatus of claim 21, wherein the first operation mode is an away home mode, and wherein the one or more functions associated with the away home mode comprises at least one of:

turning off at least one of: a television (TV), an air conditioner, a gas valve, or lighting devices, closing curtains, and turning on at least one of: a door lighting device, a security device, or a door lock.

* * * * *